US005202858A

United States Patent [19]

Kanzaki

[11] Patent Number: 5,202,858

[45] Date of Patent: Apr. 13, 1993

[54] ANALOG ELECTRONIC TIMEPIECE HAVING AN ELECTRIC-OPTICAL DISPLAY DEVICE

[75] Inventor: Takashi Kanzaki, Akishima, Japan

[73] Assignee: Casio Computer Co., Ltd., Tokyo, Japan

[21] Appl. No.: 796,698

[22] Filed: Nov. 22, 1991

[30] Foreign Application Priority Data

Nov. 28, 1990 [JP] Japan ..... 2-322676
Dec. 31, 1990 [JP] Japan ..... 2-417463

[51] Int. Cl.[5] ..... G04B 25/00; G04B 19/04

[52] U.S. Cl. ..... 368/71; 368/80; 368/82; 368/223

[58] Field of Search ..... 368/71, 76, 80, 82–84, 368/223, 228, 239–242

[56] References Cited

U.S. PATENT DOCUMENTS

| | | | |
|---|---|---|---|
| 4,043,116 | 8/1977 | Schlappi | 368/88 |
| 4,396,294 | 8/1983 | Yoshida | 368/71 |
| 4,413,915 | 11/1983 | Besson | 368/71 |
| 4,470,708 | 9/1984 | Nee | 368/276 |
| 4,488,818 | 12/1984 | Saurer et al. | 368/71 |
| 4,697,931 | 10/1987 | Okuyama et al. | 368/223 |

FOREIGN PATENT DOCUMENTS

| | | |
|---|---|---|
| 1-91291 | 6/1989 | Japan . |
| 1-242987 | 9/1989 | Japan . |
| 2052115 | 1/1981 | United Kingdom . |

OTHER PUBLICATIONS

Patent Abstracts of Japan, vol. 014, No. 029, Jan., 1990 Composite Dispaly Electronic Time-Piece, Kato Yoshiaki.

Patent Abstracts of Japan, vol. 135, No. 000, Dec., 1989 Combined Display Electronic Timepiece, Ichikawa Shingo.

Patent Abstracts of Japan, vol. 14, No. 029, Oct. 20, 1989 Citizen Watch Co., Ltd., Kato Yoshiaki, Composite Display Electronic Time-Piece.

*Primary Examiner*—Vit W. Miska

*Attorney, Agent, or Firm*—Frishauf, Holtz, Goodman & Woodward

[57] ABSTRACT

An analog electronic timepiece includes a dial plate in which an opening is formed, an electric-optical display panel arranged below the opening, and a shutter plate movably mounted between the dial plate and the display panel. The shutter plate is moved to a first position, in which only one of two types of data is exposed, when the above described one data is displayed on the display panel, and is moved to a second position, in which only the other data is exposed so that any not-displayed portions in the display panel is not exposed, when the other data is displayed on the display panel, the two types of data being different from each other in the number of displaying digits for displaying them.

34 Claims, 33 Drawing Sheets

M=0 (SR;0)

M=1 (SR;20)

M=2 (SR;40)

M=3 (SR;50)

M=0 (SR;0)

M=1 (SR;15)

M=2 (SR;30)

MR=3 (SR;45)

M=0 (SR;0)

M=1 (SR;10)

M=2 (SR;34)

ANALOG ELECTRONIC TIMEPIECE HAVING AN ELECTRIC-OPTICAL DISPLAY DEVICE

BACKGROUND OF THE INVENTION

1. Field of the Invention

This invention relates to an analog electronic timepiece having an electric-optical display device for displaying data.

2. Description of the Related Art

In an attempt to offer multifunctional analog electronic timepieces, there have been proposed to form an opening in a dial plate and provide an electric-optical display device such as a liquid crystal display device in the opening, and to make the electric-optical display device display alternatively various information, such as date, alarming time, stop-watch measuring time, schedule, and telephone numbers, etc.

However, these known analog electronic timepieces of this type injure their appearance because display surfaces of their electric-optical display devices are always exposed even when there is no need to display information thereon.

To improve their appearance when there is no need to display information, Published Unexamined Japanese Patent Application No. 1-242987 and Published Unexamined Japanese Utility Model Application No. 1-91291 propose to provide a shutter plate for opening and closing the opening of the dial plate between the dial plate and the liquid crystal display device arranged under the opening in such a manner that a switch is operated to drive a pulse motor and thereby moving the shutter plate to expose the display surface of the liquid crystal display device in the opening only when data should be displayed on the liquid crystal display device.

With such arrangement, the appearance of the analog electronic timepiece is not injured because the electric-optical display device is covered by the shutter plate when no data is displayed thereon.

However, the appearance of the analog electronic timepiece has been still injured when the electric-optical display device is exposed in the opening of the dial plate to display date thereon.

Namely, the number of display digits in the display surface of the electric-optical display device, which are needed for displaying data, is changed by the type of information to be displayed so that the display surface have a large number of unused display digits when each of some information is displayed on the display surface. These unused display digits appeared in a large area in the display surface deteriorate the appearance of the timepiece.

For instance, an electric-optical display device needs two display digits if the data is displayed on the display surface, and needs four display digits if both the data and the month, or the alarm time are displayed, whereas six or more than six display digits are needed to display the stop watch measuring time information. Moreover, ten or more than ten display digits are required to display the schedule information or the telephone number information. Therefore, an electric-optical display device needs more than 10 display digits to alternatively display the various information including the schedule information and the telephone number information. When an electric-optical display device display information, which needs a small number of display digits to be used to display it on the display surface, such as the date of two figures or the date and month or the alarm time of four figures, more than a half of the number of the display digits in the display surface are not used, so that recognition of these information on the display surface becomes hard and the appearance of the timepiece is injured.

SUMMARY OF THE INVENTION

In view of the above problem, the object of the present invention is to provide an analog electronic timepiece having an electric-optical display device which can alternatively display various information, can not be injured or deteriorated its appearance, and can ensure readily recognition of the information in the display device, even when the number of display digits needed for displaying information on the display device is far smaller than that of whole display digits included in the display device.

In order to achieve the above object, an analog electronic timepiece having an electric-optical display device according to the invention comprises: a dial plate in which an opening is formed; time-indicating hand means for pivotally moving hands on the dial plate to indicate the time; electric-optical display means, arranged below the opening of the dial plate and having a plurality of display digits for displaying data; a shutter plate mounted between the dial plate and the electric-optical display means; data generating means for generating at least two different types of data which require the different numbers of display digits to be used to display them on the electric-optical display means; display control means for selectively displaying the two types of data generated by the data generating means on the electric-optical means; and shutter plate movement control means for moving the shutter plate to a first position, in which only one data is exposed through the opening of the dial plate, and stopping it at the first position when one of the two types of data is displayed on the electric-optical display means by the display control means, and for moving the shutter plate to a second position, in which only the other data is exposed through the opening of the dial plate, and stopping it at the second position when the other type of data is displayed on the electric-optical display means.

With such an arrangement, the appearance of the timepiece is not injured or deteriorated and the information displayed on the electric-optical display device can be readily recognized because the display digits which are not used in the display device are not exposed when the number of display digits required to display information on the electric-optical display device is far smaller than that of whole display digits included in the display device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Now, the present invention will be described in greater detail by referring to the accompanying drawings that illustrate preferred embodiments of the invention.

(1) 1st Embodiment

A first embodiment of the invention will be described by referring to FIGS. 1 through 9.

(a) Construction

Figure 1:
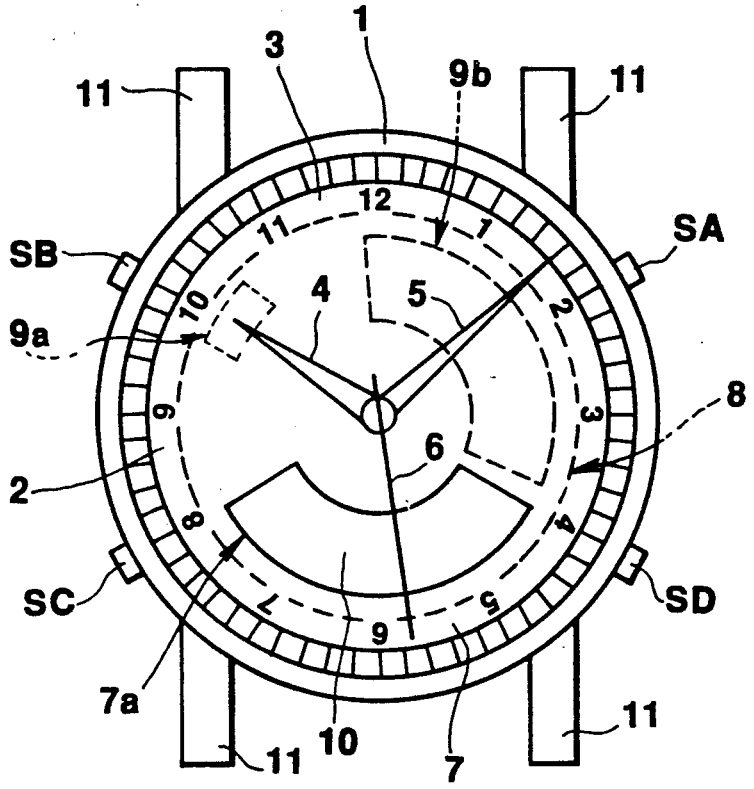
FIG. 1 is a plan view of a first embodiment of the electronic wrist watch of the invention with its opening of a dial plate being closed by a shutter plate.

FIG. 1 shows an outer appearance view of the embodiment.

On a front surface of watch case 1, a hand display portion 3 covered by a watch glass 2 is arranged. In the hand display portion 3, an hour hand 4, a minute hand 5, a second hand 6, and a dial plate 7 are mounted. In the dial plate 7, an opening portion 7*a* having a part of a circular arc the center angle of which is about 120° around a pivotal center of the hands. Under the display window portion 7*a*, a liquid crystal display panel 10 is arranged. A disc-like shutter plate 8 which is rotatable around the pivotal center of the hands is arranged at a position located behind the dial plate 7 and located forward the liquid crystal display panel 10, as shown by a dotted line in FIG. 1. In the shutter plate 8, a shutter-plate second opening portion 9*b* and a shutter-plate first opening portion 9*a* are formed. The shutter-plate second opening portion 9*b* overlaps with the window portion 7*a* to expose the entire display surface of the liquid crystal display panel 10 when the utter plate 8 is rotated. The shutter-plate first opening portion 9*a* is angularly separated from the center of the shutter-plate second opening portion 9*b* by 120° and exposes only a part of the lower half of the display surface of the liquid crystal display panel 10 when the shutter-plate first opening portion 9*a* overlaps with the display window portion 7*a* as the rotation of the shutter plate 8.

Four push-button switches SA through SD and a two pairs of band attaching portions 11 are mounted on a periphery of the watch case.

The surface of the shutter plate 8 have the same color as that of the dial plate 7, so that the display window portion 7a is not be recognized at all when it is closed by the shutter plate 8 as shown in FIG. 1.

Figure 2:
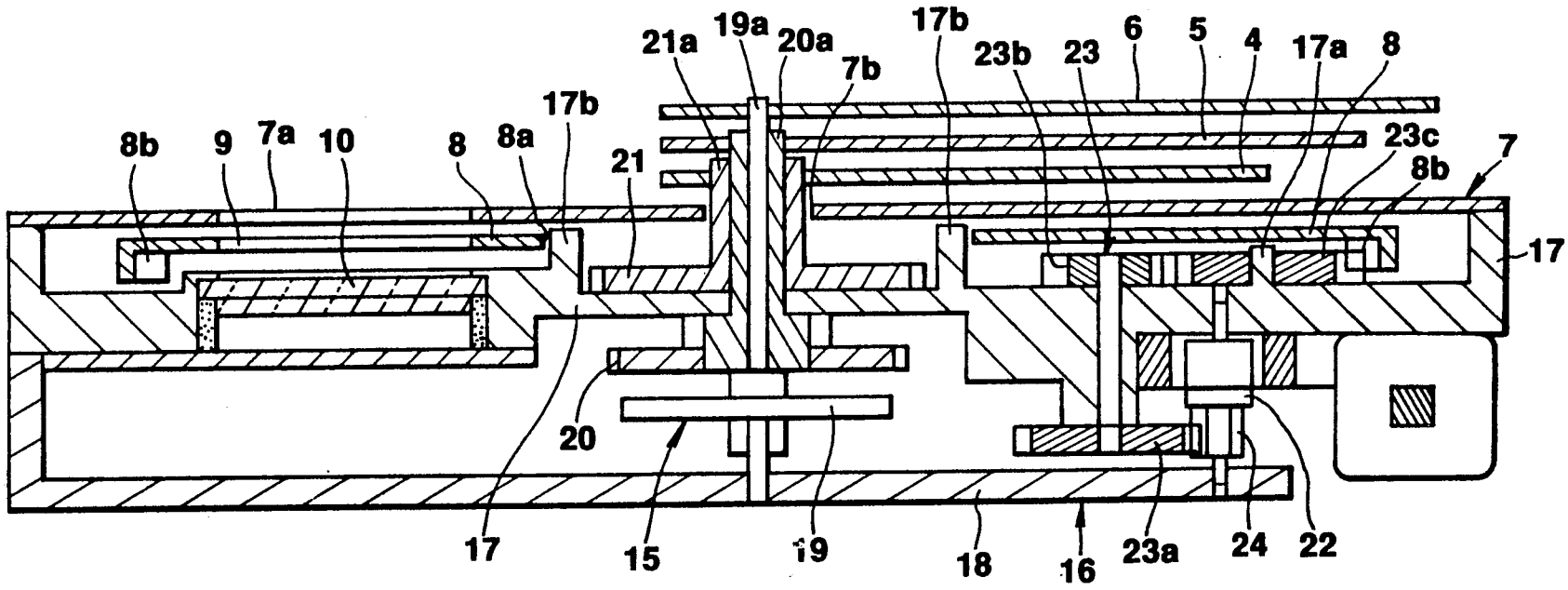
FIG. 2 is a sectional view of a main portion of the electronic wrist watch of FIG. 1.

FIG. 2 shows a main portion of an analog movement in the above described watch case. The analog movement is constructed by a gear train mechanism 15 and a shutter opening/closing device 16, and drives the hour hand 4, minute hand 5 and second hand 6 to indicate time. The gear train mechanism 15 is driven by a hand drive stepping motor (not shown) to drive the hands, and a second wheel 19 thereof is rotatably arranged between a main plate 17 and a bearing plate 18. A center wheel 20 is rotatably attached to a shaft 19a of the second wheel 19, and an hour wheel 21 is rotatably attached to a portion of a tubular shaft 20a of the center wheel 20 located above the main plate 17. The shaft 19a of the second wheel 19 projects upward from the main plate 17 and the second hand 6 is attached to the projected end. The second wheel 19 is driven by a stepping motor by way of an intermediate wheel (not shown) to drive the second hand 6. The tubular shaft 20a of the center wheel 20 projects upward from the main plate 17, and the minute hand 5 is attached to the projected end. The rotation of the second wheel 19 is transmitted to the center wheel 20 by way of a third wheel (not shown) to drive the minute hand 5. The hour hand 4 is attached to an upper end of a tubular shaft 21a of the hour wheel 21, the rotation of the center wheel 20 is transmitted to the hour wheel 21 by way of a minute wheel (not shown) to drive the hour hand 4.

The shutter opening/closing device 16 is used to drive the shutter plate 8, and is constructed by a shutter drive stepping motor 22 and a gear train mechanism 23 both of which are attached to the main plate 17. The gear train mechanism 23 is constructed by a first gear wheel 23a engaged with a rotor pinion 24 of the shutter drive stepping motor 22, a second gear wheel 23b fixed to the shaft of this first gear wheel 23a, and a third gear wheel 23c rotatably attached to a projection 17a of the main plate 17 and engaged with the second gear wheel 23b.

The dial plate 7 is fixed to the main plate 17, and the shutter plate 8 is rotatably arranged under the dial plate 7. Further the liquid crystal display panel 10 is arranged below the shutter plate 8. A through hole 7b for receiving the tubular shaft 21a of the hour wheel 21 is formed in the center of the dial plate 7, and further the display window portion 7a that has the same shape as that of the shutter-plate second opening portion 9b and can overlap therewith as described above is formed in the dial plate 7. The shutter plate 8 is used to cover the liquid crystal display panel 10 and removably closes the display window portion 7a of the dial plate 7 described above. The shutter plate 8 has a disc-like shape in the center of which a through hole 8a for receiving a projecting portion 17b of the main plate 17 is formed, and further the shutter-plate first opening portion 9a and the shutter-plate second opening portion 9b as shown in FIG. 1 and described above are formed in the shutter plate 8. An internal gear 8b is mounted near the outer periphery of the under surface of the shutter plate 8, and is engaged with the third gear wheel 23c described above. Thus, when the shutter drive stepping motor 22 is operated, its rotation is transmitted to the internal gear 8b by way of the rotor pinion 24, the first gear wheel 23a, the second gear wheel 23b, and the third gear wheel 23c to rotate the shutter plate 8, thereby selectively opening and closing the display window portion 7a.

Figure 3:
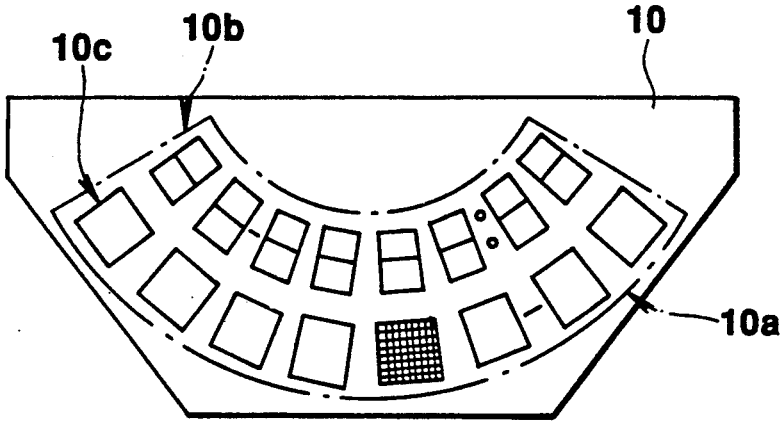
FIG. 3 is a plan view of a liquid crystal display panel of the electronic wrist watch of FIG. 1.

FIG. 3 shows an arrangement of display digits in the display surface of the liquid crystal display panel 10. An exposed portion 10a surrounded by one-dot chain line in FIG. 3 becomes visible through the display window portion 7a and the shutter-plate second opening portion 9b when the second opening portion 9b overlaps with the display window portion 7a by the rotation of the shutter plate 8. Seven-segmented display digits, etc. for 8 figures or letters are arranged in an upper half region 10b of the exposed portion 10a, and 8 dots-matrix display portion, etc. for 8×8 dots display are arranged in a lower half region 10c thereof.

Figure 4:
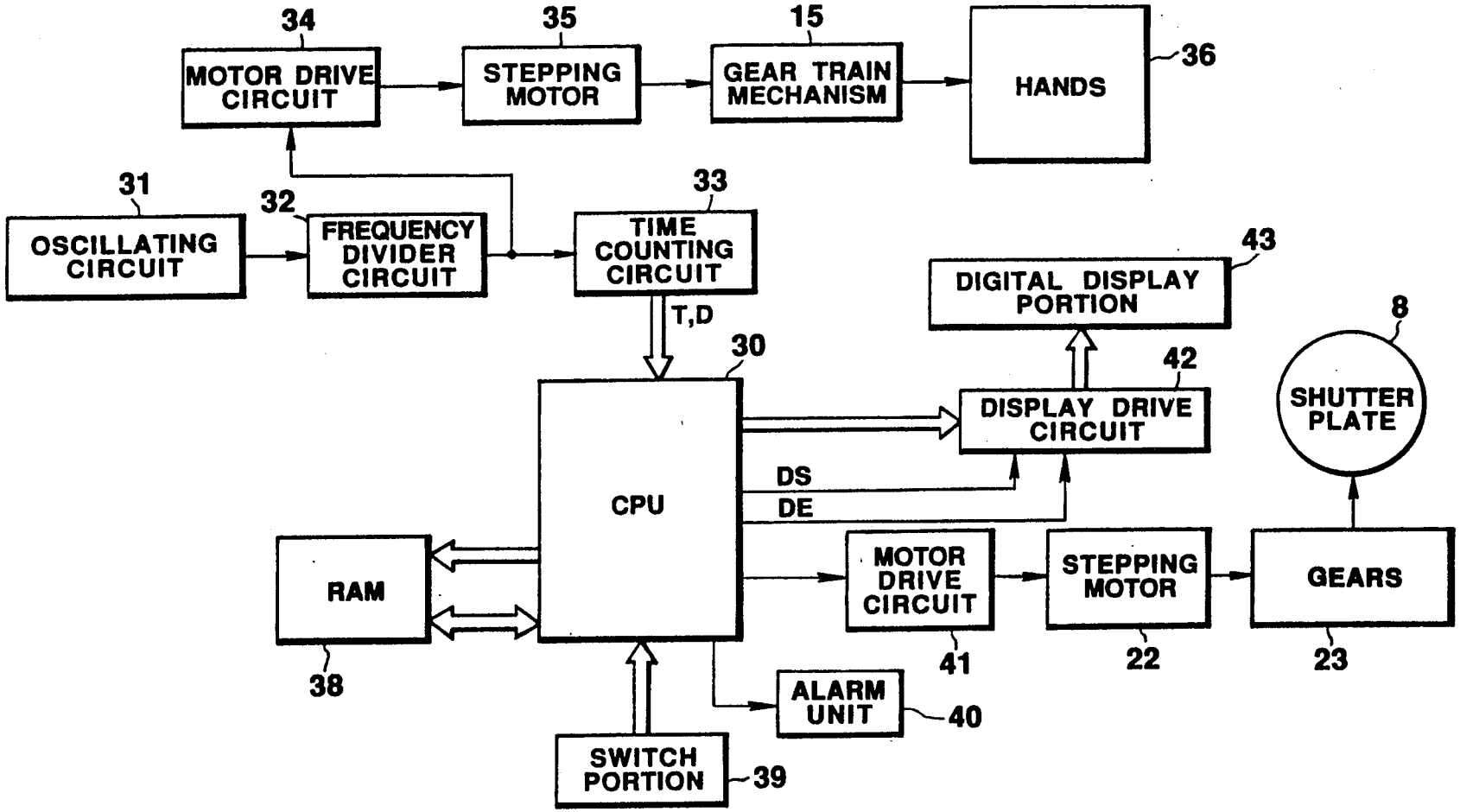
FIG. 4 is a block diagram showing a circuit construction of the electronic wrist watch of FIG. 1.

FIG. 4 shows a circuit construction of the first embodiment. In this embodiment, all circuit portions are connected to a CPU 30 in which data supplied thereto is processed and then send out therefrom, and also the CPU 30 supplies signal to the respective circuit portions to control them.

An oscillator circuit 31 regularly sends out a constant frequency signal. A frequency divider circuit 32 divides the constant frequency signal from the oscillating circuit 31 to a predetermined frequency, and sends it to a time counting circuit 33 and a motor drive circuit 34. The time counting circuit 33 counts the number of signals from the frequency divider circuit 32 to obtain the current time T and date D, and then sent out the current time and data T, D to the CPU 30.

The motor drive circuit 34 receives the signals from the frequency divider circuit 32 and drives a stepping motor 35. The stepping motor 35 driven by the motor drive circuit 34 transmits a rotational force to hands 36 by way of the train gear mechanism 15 to move pivotaly the hands 36.

A RAM 38 is controlled by the CPU 30 to store data from the CPU 30 and send any of the data stored therein to the CPU 30. A switch portion 39 comprises the above described push button switches SA through SD, and transmits a switch ON signal corresponding to one of the push button switches to the CPU 30 when the above described one of the switches is depressed. An alarm unit 40 generates an alarm sound when it receives a signal from the CPU 30.

A motor drive circuit 41 drives the shutter drive stepping motor 22 to rotate its output shaft by a predetermined angle at each time when it receives a signal from the CPU 30. The rotation of the output shaft of the shutter drive stepping motor 22 is transmitted to the shutter plate 8 by way of the gear train mechanism 23 to rotate the shutter plate 8. The shutter plate 8 is rotated by 6° (or 360°/60 steps) at each time when the CPU 30 transmits a signal to the motor drive circuit 41, so that the shutter plate 8 makes one turn by 60 steps. A display drive circuit 42 makes a digital display portion 43 display data transmitted from the CPU 30 on the liquid crystal display panel 10 when it receives a display start signal DS from the CPU 30, and makes the digital display portion 43 stop the displaying action when it receives a display stop signal DE from the CUP 30.

Figure 5:
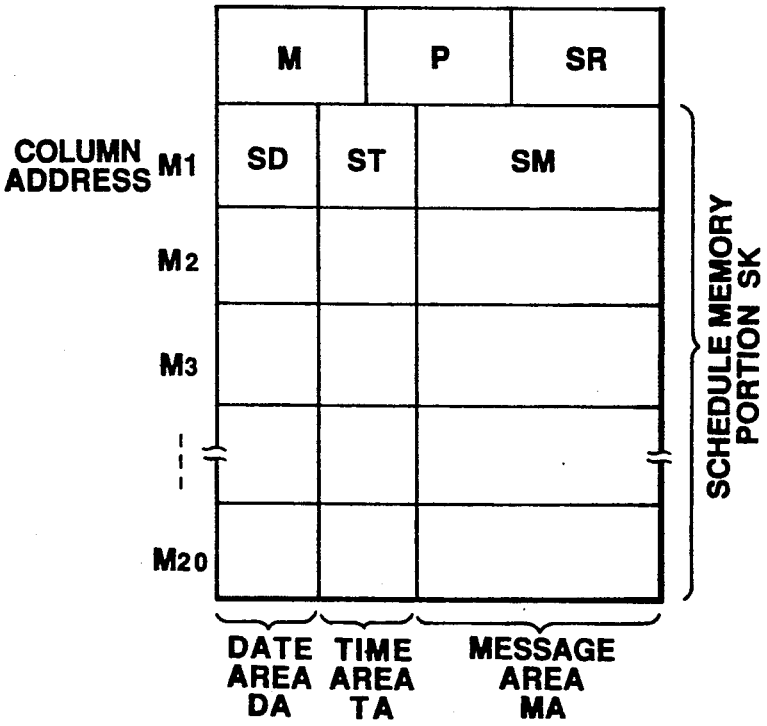
FIG. 5 shows, a construction of a RAM 38 of FIG. 4.

FIG. 5 shows a construction of the RAM 38.

Here, a mode register M for designating a mode of action designates a watch mode in which the display window portion 7a is closed by the shutter plate 8 and only the current time is indicated by the hands 36, when 0 is set in the mode register M. When 1 is set in the mode register M, it designates a date display mode in which the current date is displayed on the middle portion of a lower half portion 10c of the liquid crystal display panel 10 and is visible through the shutter-plate first opening portion 9a of the shutter plate 8. When 2 is set in the mode register M, it designates a schedule display mode in which one of schedule informations stored in a schedule memory portion is displayed on the liquid crystal display panel 10 and is visible through the shutter-plate second opening portion 9b of the shutter plate 8. Finally, if 3 is set in the mode register M, it designates a date/time display mode in which the current date and time are displayed in the right half of the liquid crystal display panel 10 and the left half of the liquid crystal display panel 10 is closed by the shutter plate 8.

A register P designates one of schedule informations stored in a schedule memory portion SK by using the column addresses of the schedule memory position SK to display the above described one on the liquid crystal display panel 10. A position register SR is set with a step number corresponding to an angular position of the shutter plate 8. When the left end of the shutter-plate second opening portion 9b of the shutter plate 8 is located at the right end of the liquid crystal display panel 10 corresponding to the four o'clock marker on the dial plate 7 (the state as shown in FIG. 1), the step number is 0. The step number is increased by one at each time when the shutter plate 8 rotates counterclockwise by 6°.

The schedule memory portion SK is constructed by 20 columns which are numbered by column addresses M1 through M20. Each column is constructed by a date area DA, a time area TA, and a message area MA for memorizing the date, the time and a message for each scheduled information, respectively. The schedule informations are memorized in the schedule memory portion SK in such order that a schedule information having the earlier date and time is numbered by the smaller-numbered column address in the schedule memory portion SK.

(b) Action

The action of the first embodiment constructed as described above will be explained in the following.

Figure 6:
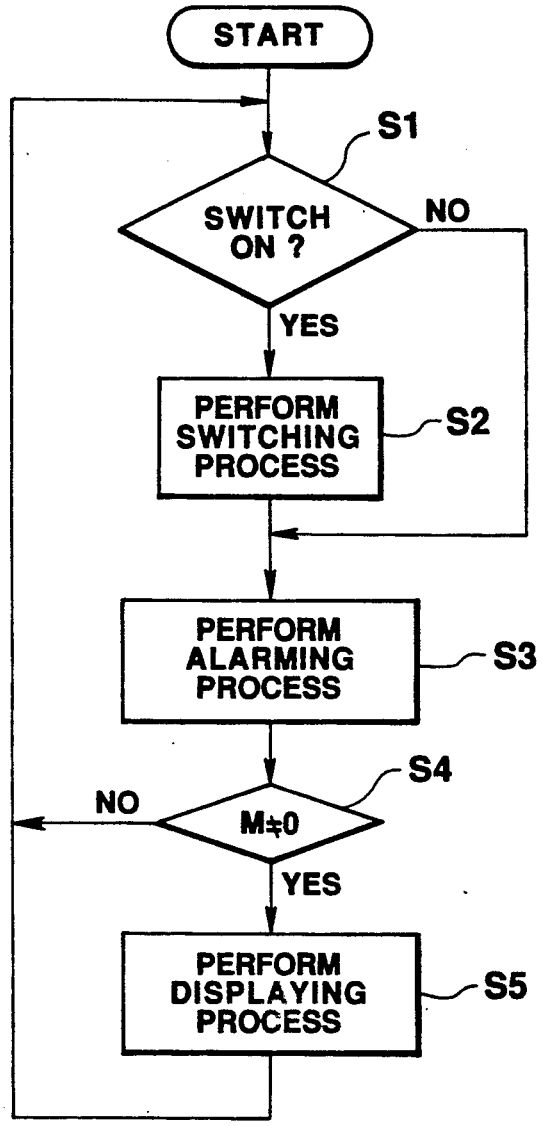
FIG. 6 is a general flow chart illustrating an action of the circuit of FIG. 4.

FIG. 6 is a general flow chart schematically illustrating the overall action of the embodiment. In a step S1, it is checked whether there is a switch input or not. If there is a switch input, a switching process is performed at a step S2 and then an alarming process is performed in a step S3. If it is determined in the step S1 that there is no switch input, the alarming process is performed immediately in the step S3 by no way of the step S2. In the alarming process, it is checked whether the current time T and date D transmitted from the time counting circuit 33 is consistent with the time and date of any one of the schedule informations stored in the schedule memory portion SK or not. If the current time T and data D is consistent with the time and data of one schedule information, the shutter plate 8 is rotated to bring the shutter-plate second opening portion 9b under the display window portion 7a so that the display surface of the liquid crystal display panel 10 is fully opened and a content of the schedule is displayed on the display 10. At the same time, a signal is sent to the alarm unit 40 to make it generate and emit an alarm sound for a predetermined period of time. Then, in a step S4, it is checked that the mode register M is set at any number excluding 0 and any mode other than the watch mode is set. If it is determined that any mode other than the watch mode is set, a displaying process for displaying various data on the liquid crystal display panel 10 is performed in a step S5 and then the step S1 is reperformed. If it is determined that the watch mode is set in the step S4, the action directly goes back to the step S1 and repeats the same performance as described above.

Figure 7:
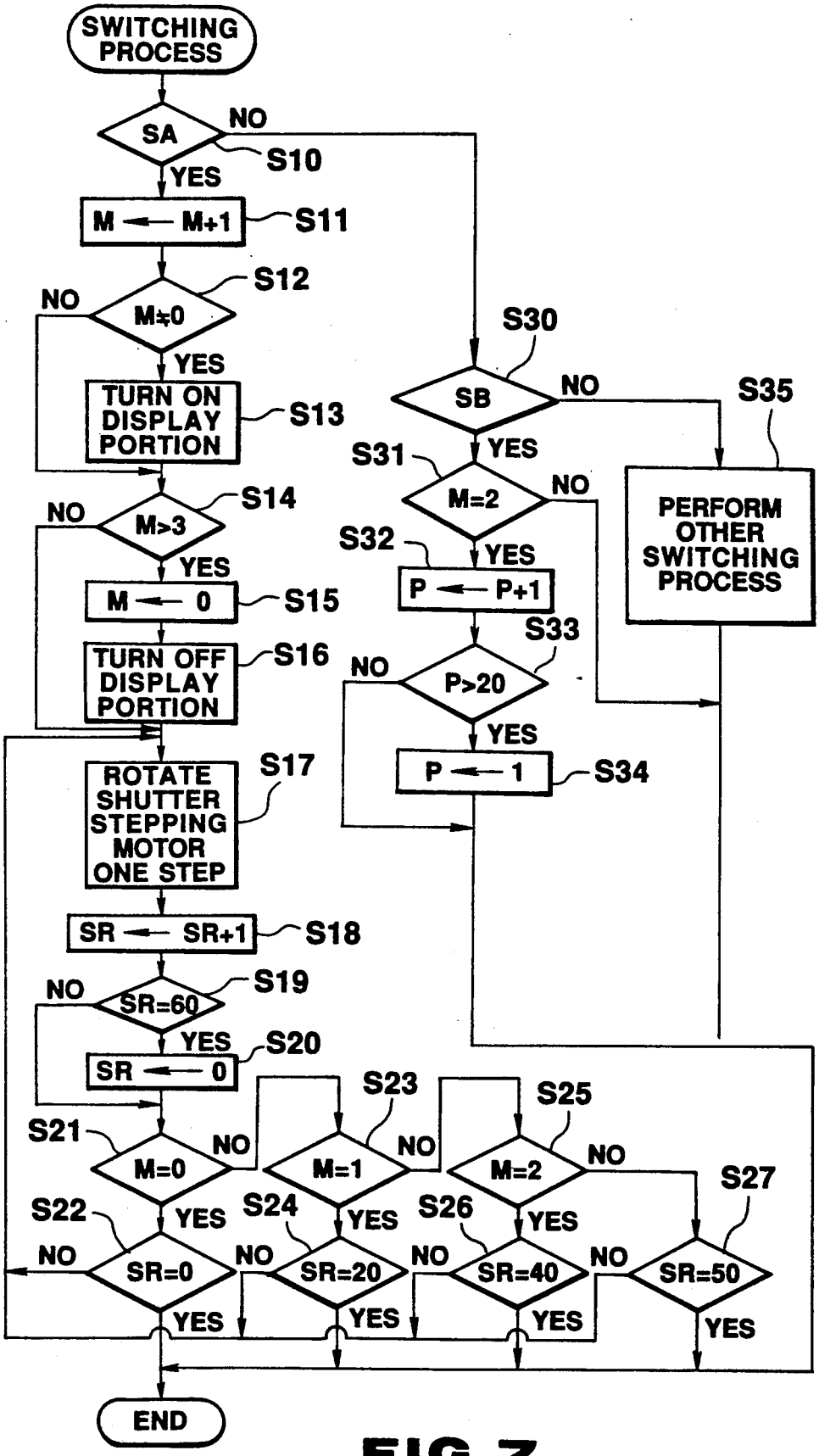
FIG. 7 is a flow chart illustrating in detail a switching process in the flow chart of FIG. 6.
Figure 8:
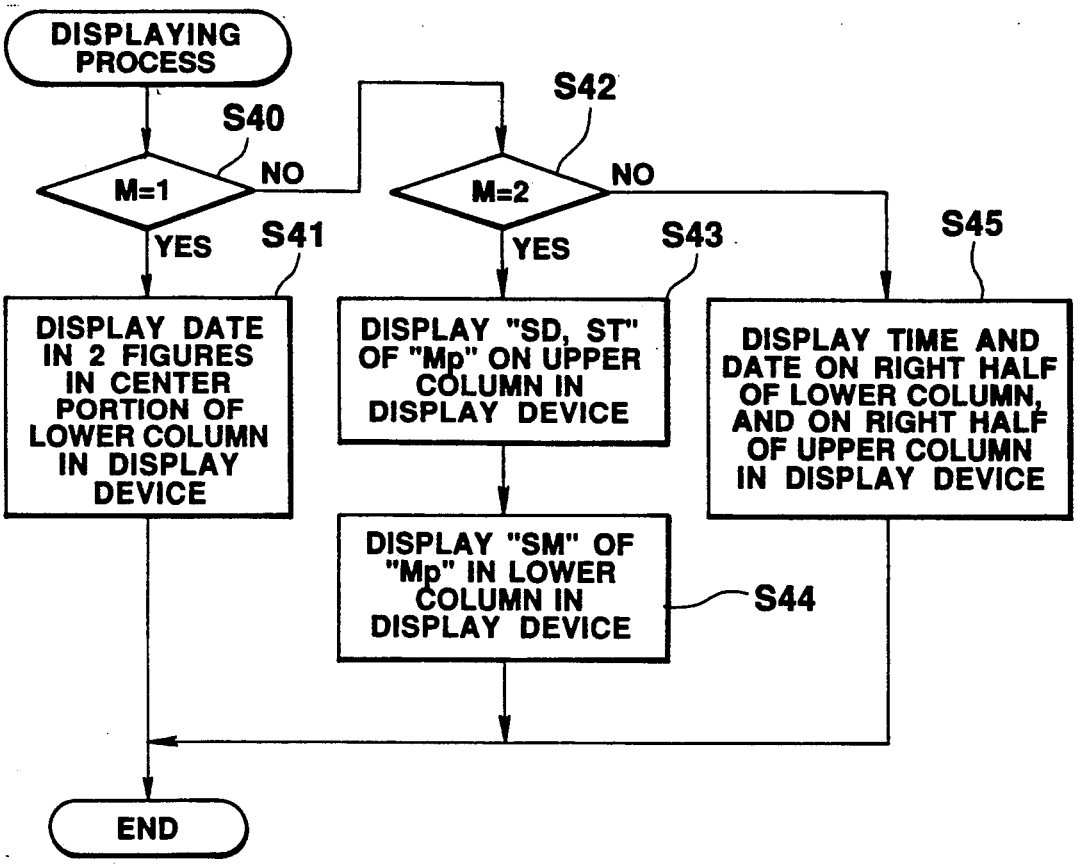
FIG. 8 is a flow chart illustrating in detail a displaying process in the flow chart of FIG. 6.

FIG. 7 is a flow chart illustrating in detail the switching process (in the step S2) of FIG. 6, and FIG. 8 is a flow chart illustrating in detail the displaying process (in the step S5) of FIG. 6. Now, actions in various states will be described below.

Figure 9A:
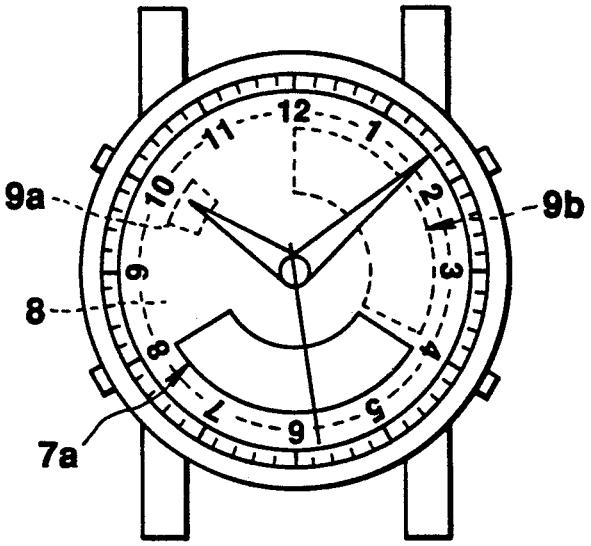
FIG. 9A is a plan view of the electronic wrist watch of FIG. 1 operating in a watch mode.

At first, assume that 0 is set in the mode register M to set the watch mode and 0 is set in the position register SR so that the shutter plate 8 is located at a position as shown in FIG. 9A relative to the display window portion 7a and therefore the latter is entirely covered by the former. In this condition, the checking process of the step S1, the alarming process of the step S3, and the checking process of the step S4 are repeated in this order until the step S1 checks the switch input, and in the step S4, it is checked that 0 is set in the mode register M and the watch mode is set.

Figure 9B:
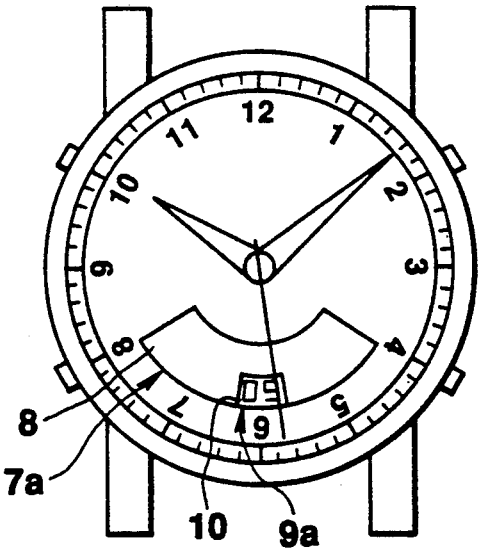
FIG. 9B is a plan view of the electronic wrist watch of FIG. 1 operating in a date displaying mode.

When the push button switch SA is depressed to change the watch mode with the data display mode, the action proceeds from the step S1 to the step S2 for the switching process as illustrated in FIG. 7. The depression the push button switch SA is detected in a step S10 and then, in a step S11, the value in the mode register M is increased by one to become 1 to set the date display mode. Then, in a step S12, it is determined that the mode register M is not set at 0 and the watch mode is not set, and in a step S13, a display start signal DS is transferred to the display drive circuit 42 to make the liquid crystal display panel 10 of the digital display portion 43 be set in a stand-by condition for displaying data. Thereafter, in a step S14, it is determined that the value in the mode register M does not exceed 3 and then, in a step S17, a signal is transmitted to the motor drive circuit 41 to make the shutter drive stepping motor 22 to rotate its output shaft by one step. The rotation of the output shaft of the shutter drive stepping motor 22 is transmitted to the shutter plate 8, by way of the rotor pinion 24 of the motor 22 and the first gear wheel 23a, the second gear wheel 23b, the third gear wheel 23c and the internal gear 8b of the gear train mechanism 23 shown in FIG. 2, to rotate the shutter plate 8 counterclockwise by one step (6°). Then, in a step S18, the value stored in the position register SR is increased by one to become 1 so that the one step rotation of the shutter plate 8 is memorized, and, in a step S19, it is determined that the value of the position register SR has not reached 60 yet. Thereafter, the in a step S21, it is determined that the value set in the mode register M is no longer 0 and the watch mode is no longer set, and further in a step S23 it is determined that the value in the mode register M is 1 and therefore the date display mode is set. In a step S24, it is determined that the value in the position register SR has not reached 20 yet and the action returns to the step S17. Then, the processes of the steps S17 through S19, S21, S23 and S24 are repeated until the value stored in the position register SR becomes 20. When the value of the position register SR has reached 20 and the shutter plate 8 has rotated by 120° from a position when the watch mode it set, the shutter-plate first opening portion 9a of the shutter plate 8 is arranged at the middle portion of the display window portion 7a to expose the middle portion of the lower half portion 10c of the liquid crystal display panel 10 as shown in FIG. 9B. And, this condition is detected in the step S24 and the switching process is terminated. Then, the alarming process of the step S3 of FIG. 6 is performed, and in the step S4 it is determined that the value set in the mode register M is not 0 and a mode other than the watch mode is set, so that the action proceeds to the step S5, where the displaying process as illustrated in FIG. 8 is performed. In a step S40 of the displaying process, it is determined that 1 is set in the mode register M and, in a step S41, the current date is displayed in two display digits at the middle portion of the lower half portion 10c of the liquid crystal display panel 10 and the action returns to the step S1. If for example, the current date is 5th, the liquid crystal display panel 10 displays it as shown in FIG. 9B.

The date display mode is changed with the schedule display mode to confirm the schedules stored in the schedule memory portion SK by operating the push button switch SA. Upon detecting in the step S10 of FIG. 7 that the push button switch SA is depressed, the value in the mode register M is increased by one to become 2 to set the schedule mode. Then, in the step S12, it is determined that the value in the mode register M is not 0 and the liquid crystal display panel 10 is set in a display stand-by condition. In the step S14, it is determined that the value in the mode register M does not exceed 3. Then, in the step 17, a signal is transmitted to the motor drive circuit 41 to make the shutter drive stepping motor 22 rotate its output shaft by one step and therefore the shutter plate 8 is rotated by one step and, in the step S18, the value in the position register SR is increased by one. Then, in the step S19, it is determined that the value in the position register SR has not reached 60 yet and the action is processed in the steps S21 and S23, and steps S25, S26 and returns to the step S17, where it is determined in the step S25 that the value in the mode register M is 2 and the schedule display mode is set, and in a step 26 it is further determined that the value in the position register SR has not reached 40 yet. Thereafter, the processes of the steps S17 through S19, S21, S23, S25 and S26 are repeated until the value in the position register SR becomes 40.

Figure 9C:
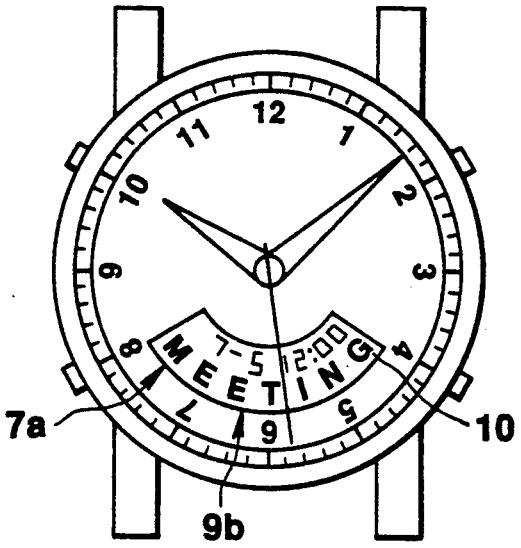
FIG. 9C is a plan view of the embodiment of FIG. 1 operating in a schedule displaying mode.

When it is determined in the step S26 that the value in the position register SR has reached 40 and therefore the shutter plate 8 has rotated further by 120° from the position in the date display mode and the shutter-plate second opening portion 9b of the shutter plate 8 is overlapped with the display window portion 7a to completely expose the display surface of the liquid crystal display panel 10 as shown in FIG. 9C, the action goes to the step S3 of FIG. 6. After completion of the alarming process in the step S3, it is determined in the step 4 that the value in the mode register M is not 0 and therefore the watch mode is not set, and the action goes to the displaying process (FIG. 8) in the step S5. In the displaying process as illustrated in FIG. 8, the action proceeds by way of a step S40 to a step S42 where it is determined that the value in the mode register M is 2 and the schedule display mode is set and, in a step S43, a scheduled date (SD) and a scheduled time (ST) of a schedule designated by the register P in the schedule memory portion SK are displayed on the upper half portion 10b of the display surface of the liquid crystal display panel 10. Then, in a step S44, a message (SM) referring to the designated schedule is displayed on the lower half portion 10c of the display surface of the liquid crystal display panel 10. If the schedule designated by the register P is a meeting starting at 2 o'clock on July 5th, the liquid crystal display panel 10 displays the schedule information, as illustrated in FIG. 9C.

In order to sequentially display all schedule informations stored in the schedule memory portion SK on the liquid crystal display panel 10, the push button switch SB is depressed. After each detection of depression of the push button switch SB in a step S30, it is determined in a step S31 that 2 is set in the mode register M and therefore the schedule mode is set. Then, in a step S32 the value in the register P is increased by one, and in a step S33 it is checked whether the value in the register P exceeds 20 or not. If it exceeds 20, 1 is set anew in the register P in a step S34. In this way, the value in the register P is increased one by one through the steps S32 to S34 until it reaches 20 from 1. Thereafter, the steps S3 and S4 of FIG. 6 are performed, and then the steps S40 through S44 in the displaying process of FIG. 8 are performed to display the date and time and the message for a schedule designated anew by the register P.

Figure 9D:
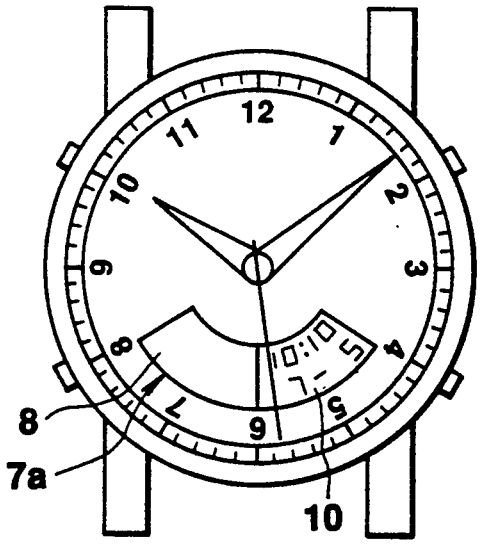
FIG. 9D is a plan view of the electronic wrist watch of FIG. 1 operating in a date/time displaying mode.

In order to change the schedule display mode with the date/time display mode, the push button switch SA is depressed. After detecting depression of the push button switch SA in the step S10 of FIG. 7, the value in the mode register M is increased by one to become 3 and then in the step S13 after performing the step S12, the liquid crystal display panel 10 is set in the stand-by condition for displaying information. In the step S14 it is determined that the value set in the mode register M is not exceed 3, and then in the step S17 a signal is transmitted to the motor drive circuit 41 to make the shutter drive stepping motor 22 rotate its output shaft by one step. In the step S18 the value in the position register SR is increased by one, and, in the step S19, it is determined that the value in the position register SR has not reached 60 yet. After that, the steps S21, S23, and S25 are performed, and in a step S27 it is determined that the value in the position register SR has not reached 50 yet, and finally the action returns to the step S17. Thereafter, the processes of the steps S17 through S19, S21, S23, S25 and S27 are repeated until the value in the position register SR becomes 50. When the value in the position register SR reaches 50, the shutter plate 8 has rotated further by 60° from the position for the schedule display mode to expose the right half of the display window portion 7a with the left half of the liquid crystal display panel 10 being closed by the shutter plate 8, as illustrated in FIG. 9D. This condition is detected in the step S27 and then the action advances by way of the steps S3 and S4 of FIG. 6 to the displaying process (FIG. 8) in the step S5. In the displaying process, after performing the steps S40 and S42, the current date D and the current time T supplied from the time counting circuit 33 are displayed on the right half of the upper half portion 10b of the display surface of the liquid crystal display panel 10 in the step S45. If the current time and date are 10:10 of July 5th, the liquid crystal display panel 10 displays them as shown in FIG. 9D.

In order to change the date/time display mode with the watch mode, the push button switch SA is further depressed. When the depression of the push button switch SA is detected in the step S10, the value in the mode register M is increased by one to become 4. Then, in the step S12, it is determined that the value in the mode register M is not 0 and in the step S13 the liquid crystal display panel 10 is set in the stand-by condition to display information. When it is determined in the step S14 that the value in the mode register M is 4 and exceeds 3, the mode register M is set at 0 to set the watch mode. Then, in the step S16, a display stop signal DE is transmitted to the display drive circuit 42 to terminate the displaying action of the liquid crystal display panel 10. Thereafter, a signal is transmitted to the motor drive circuit 41 to make the shutter drive stepping motor 22 rotate its output shaft by one step and therefore the shutter plate 8 rotates by one step. Then, in the step S18, the value in the position register SR is increased by one, and in the step S19 it is determined that the value in the position register SR has not reached 60 yet, and in the step S21 it is determined that 0 is set in the mode register M and therefore the watch mode is set. When it is determined in a step S22 that the value in the position register SR has not become 0 the action returns to the step S17. Thereafter, the processes of the steps S17 through S19, S21 and S22 is repeated until the value in the position register SR becomes 60. When the value in the position register SR becomes 60 and therefore the shutter plate 8 rotates by 60° from the position in the date/time display mode, the display window portion 7*a* is completely closed by the shutter plate 8 and make the liquid crystal display panel 10 totally invisible. This condition is detected in the step S19, and the value in the position register SR is set at 0 in a step S20 and then in the step S21 it is determined that 0 is set in the mode register M and the watch mode is set. Further in the step S22, it is determined that the value in the position register SR is reduced to 0 and then the action proceeds by way of the step S3 to the step S4. When it is determined in the step S4 that the value in the mode register M has already become 0 and the watch mode is set, the action returns to the step S1 without performing the displaying process. The positional relationship between the display window portion 7*a* and the shutter-plate first and second opening portions 9*a*, 9*b* of the shutter plate 8 at that time is shown in FIG. 9A, in which the display window portion 7*a* is completely closed by the shutter plate 8 to make the liquid crystal display panel 10 totally invisible.

It is needless to say that the present invention is not limited to the above described embodiment and various modifications may be made thereto without departing from the scope of the invention. For instance, the display surface of the liquid crystal display panel 10, which is divided into the upper half portion and the lower half portion in this embodiment, may be so constructed that information is displayed thereon in a single line and the length of region in the display surface of the liquid crystal display panel 10 to be exposed for displaying information may be changed by moving the shutter plate 8. Further the shutter plate 8, which is rotatable around the pivotal center of the hands in this embodiment, may be arranged excentrically to the pivotal center of the hands in a case that the diameter of the shutter plate 8 is largely smaller than that of the dial plate 7, and further the shutter plate may be arrange to move horizontally.

(2) 2nd Embodiment

Now, a second embodiment of the invention will be described by referring to FIGS. 10 through 16.

(a) Construction

Figure 15A:
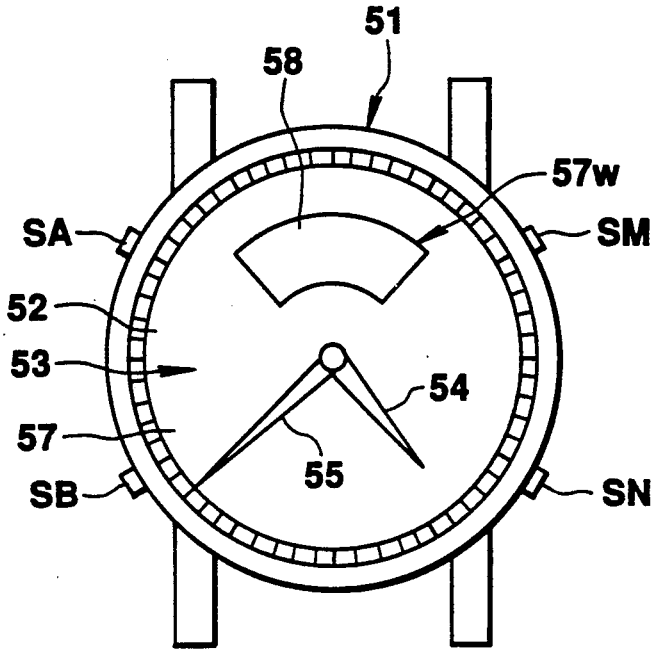
FIG. 15A is a plan view of the electronic wrist watch of FIG. 10 operating in a normal mode.

FIG. 15A shows an outside view of the embodiment.

A hand display portion 53 covered by a watch glass 52 is provide in a front surface of a watch case 51. An hour hand 54, a minute hand 55, a second hand 56 and a dial plate 57 are provided in the hand display portion 53. A display window portion 57W, shaped as a wide circular arc extending within about 90° around a pivotal center of the hands, is formed in the dial plate 57. A liquid crystal display device 60 (not shown in FIG. 15A) is arranged below the display window portion 57W so as to be visible its entire display surface through the window portion 57W. A shutter plate 58 which is rotatable around the pivotal center of the hands is arranged between the dial plate 57 and the liquid crystal display device 60.

Four push button switches SA, SB, SM and SN are provided on its outer periphery of the watch case 51.

Figure 10:
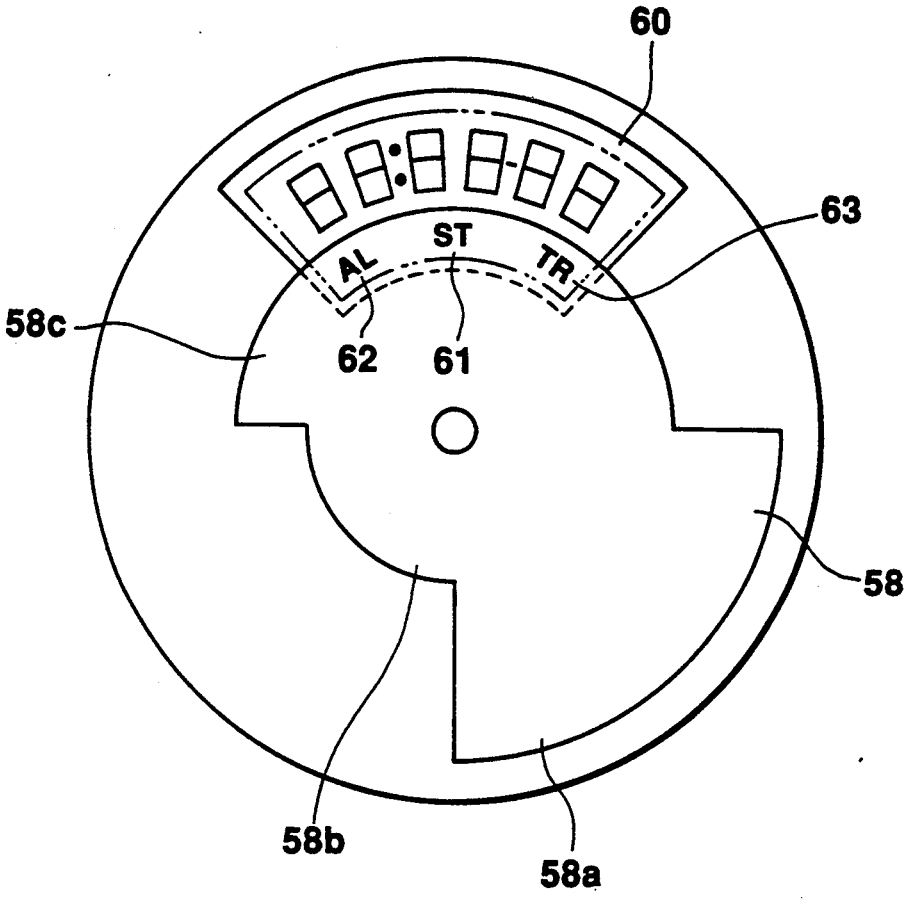
FIG. 10 is a plan view showing a shape of a shutter plate and a positional relation ship between the shutter plate and an electric-optical display device in an electronic wrist watch of a second embodiment of the invention.

FIG. 10 shows a construction of the shutter plate 58, an arrangement of display digits in the liquid crystal display device 60, and a positional relationship between the shutter plate 58 and the liquid crystal display device 60. Here, the shutter plate 58 is rotatably attached around the pivotal center of the hands. The liquid crystal display device 60 is placed behind the shutter plate 58 at a 12 o'clock portion of the dial plate 57 so as to be able to overlap the display window position 57W (being indicated by one-dot chain line in FIG. 10), and has the same shape as that of the window portion but is greater in size thereto. The shutter plate 58 is constructed by a first mask portion 58*a*, an intermediate mask portion 58*b*, and a second mask portion 58C. The first mask portion 58*a* has a sector shape with a central angle of 90° and is able to completely cover the display surface of the display device 60, the intermediary portion 58*b* has a diametrically smaller sector shape with a central angle of 90° and is able to expose the entire display surface of the display device 60, and the second mask portion 58*c* has a semicircular shape and is able to cover the lower half portion of the display surface of the liquid crystal display device 60. A stopwatch mode indicator 61 constructed by printed letters "ST" is located at a center portion of the outer periphery of the second mask portion 58*c* (that is, at a portion exposed through the display window portion 57w when the second mask portion 58*c* covers the lower half portion of the liquid crystal display device 60), an alarming time display mode indicator 62 constructed by printed letters "AL" is located at a position spaced leftwardly from the stopwatch mode indicator 61 by 30°, and a timer mode indicator 63 constructed by printed letters "TR" is located at a position spaced rightwardly from the stopwatch mode indicator 61 by 30°.

Seven-segmented display digits for 6 figures or letters are arranged in the upper half portion of the liquid crystal display device 60 (a portion not covered by the second mask portion 58*c*) to display time, and seven-segmented display digits (not shown) for 4 figures or letters are arranged in the lower half portion of the liquid crystal display device 60 (a portion that can be covered by the second mask portion 58*c*) to display data.

Figure 11:
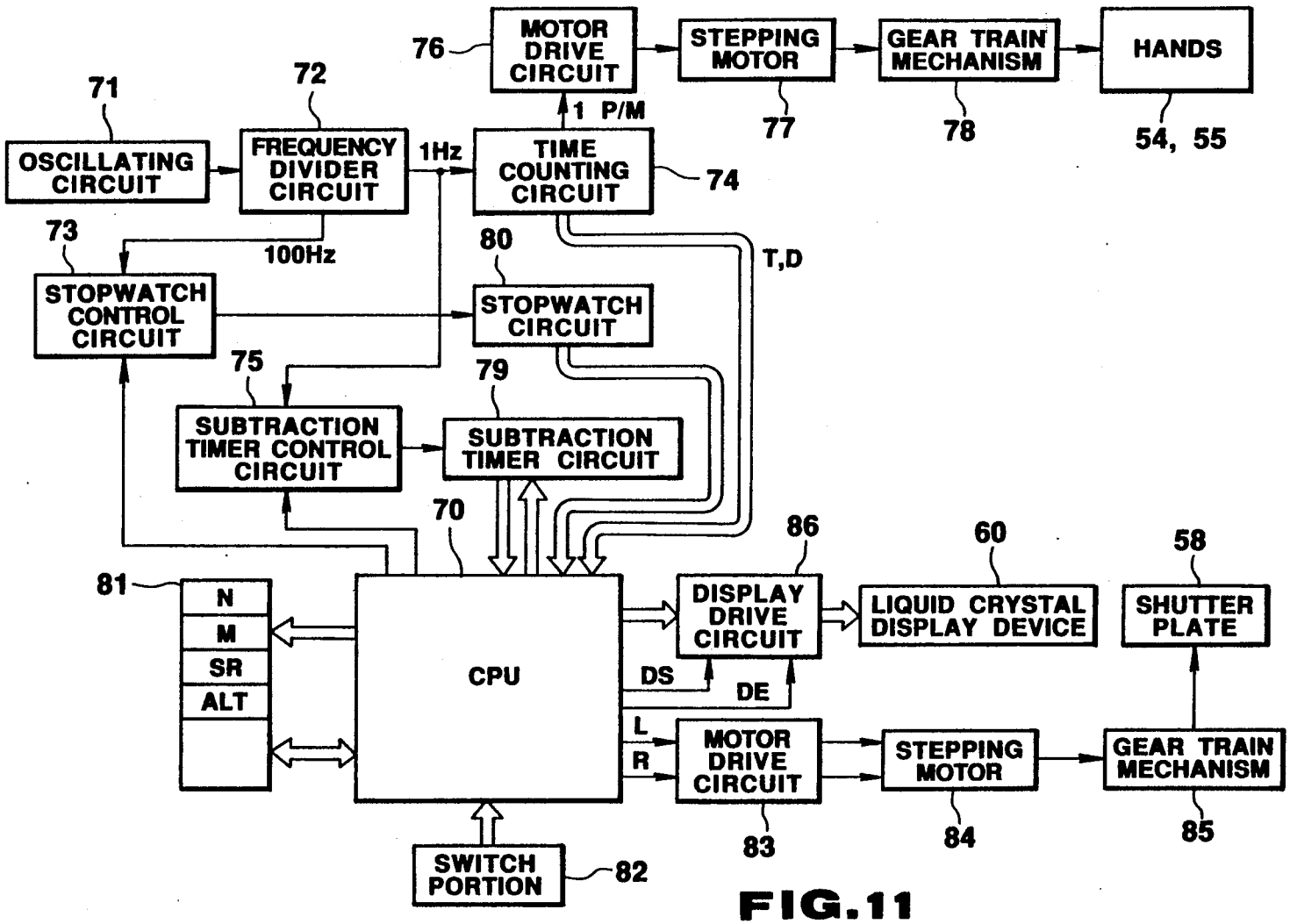
FIG. 11 is a block diagram showing a circuit construction of, the electronic wrist watch of FIG. 10.

FIG. 11 shows a construction of a circuit of the second embodiment. Here, all circuit portions are connected to a CPU 70. The CPU 70 processes data transmitted thereto and generates a processed data, and further transmits signals to the circuit portions to control them.

An oscillating circuit 71 always send out a signal of a constant frequency. A frequency divider circuit 72 divides the signal from the oscillating circuit 71 to obtain a 100 Hz signal and a 1 Hz signal, and transmits the former signal to a stopwatch circuit 73 and the latter signal to both a time counting circuit 74 and a subtraction timer control circuit 75. The time counting circuit 74 transmits a one-minute signal (1 P/M) at every one minutes to a motor drive circuit 76. The motor drive circuit 76 drives a hand drive stepping motor 77 when it receives a 1 P/M signal from the frequency divider circuit 72. The stepping motor 77 driven by the circuit 76 rotates its output shaft to transmit rotational force to the hands 54, 55 by way of a gear train mechanism 78 to pivotally move the hands 54, 55. The time counting circuit 74 counts the number of 1 Hz signals from the frequency divider circuit 72 to obtain the current time T and the current date D, and transmits them to the CPU 70.

The subtraction timer control circuit 75 forwards a 1 Hz signal received from the frequency divider circuit 72 to a subtraction timer circuit 79 each time it receives a signal from the CPU 70. The subtraction timer circuit 79 decreases the time stored therein by one second each time it receives a 1 Hz signal from the subtraction timer control circuit 75 and informs the CPU 70 of the remaining time. The stopwatch circuit 73 forwards a 100 Hz signal received from the frequency divider circuit 72 to a stopwatch circuit 80 each time it receives a signal from the CPU 70. The stopwatch circuit 80 counts the number of 100 Hz signals received to determined the elapsed period of time and informs the CPU 70 of the time.

A RAM 81 is a circuit to store data from the CPU 70 and sent back any of the data stored therein under the control of the CPU 70.

The mode register N arranged in the RAM 81 is used to specify a mode of action of the embodiment. 0 in the mode register N specifies a normal mode, where the display window portion 57W is closed by the shutter plate 58 and the current time is indicated by the time hand 54 and the minute hand 55. 1 set in the mode register N specifies a time mode, where the display window 57W is fully opened to display the current time T and the current date D obtained from the time counting circuit 74 on the liquid crystal display device 60. When 2 is set in the mode register N, it specifies an additional function mode, where only the upper half portion of the liquid crystal display device 60 is exposed to display various data thereon. The additional function mode comprises an alarm time display mode, a stopwatch mode and a timer mode, which are alternatively selected by means of the mode register M. 0 in the mode register M specifies the alarm time display mode, 1 specifies the stopwatch mode, and 2 specifies the timer mode.

The position register SR stores a step number representing the current rotary position of the shutter plate 58. The step number is 0 when the first mask portion **58*a* of the shutter plate 58 is placed exactly above the liquid crystal display device 60 to completely cover the liquid crystal display device 60, and is increased by one each time the shutter plate 58 is rotated counterclockwise by 3° (making the total number of steps required for an entire turn of the shutter plate 58** equal to 120).

The alarm time register ALT stores an alarm time given to it.

A switch portion 82 comprises four push button switches such as the push button switch SN as described earlier. When any of the push button switches are depressed, it transmits a corresponding switch input signal to the CPU 70 to inform the latter of the fact that the push button switch is operated.

A motor drive circuit 83 is a circuit for driving a shutter drive stepping motor 84 of the embodiment by a given angle each time it receives a specific signal from the CPU 70, and the rotary force of the shutter drive stepping motor 84 is transmitted to the shutter plate 58 by way of a gear train mechanism 85. The shutter plate 58 is rotated by 3° (or 360°/120 steps) counterclockwise or clockwise respectively each time the CPU 70 transmits an L or R signal to the motor drive circuit 83. A display drive circuit 86 starts driving the liquid crystal display device 60 to display data transmitted from the CPU 70 on the liquid crystal display device 60 when it receives a display start signal DS from the CPU 30, and stops driving the liquid crystal display device 60 to terminate the displaying action when it receives a display stop signal DE from the CUP 70.

(b) Action

Figure 12:
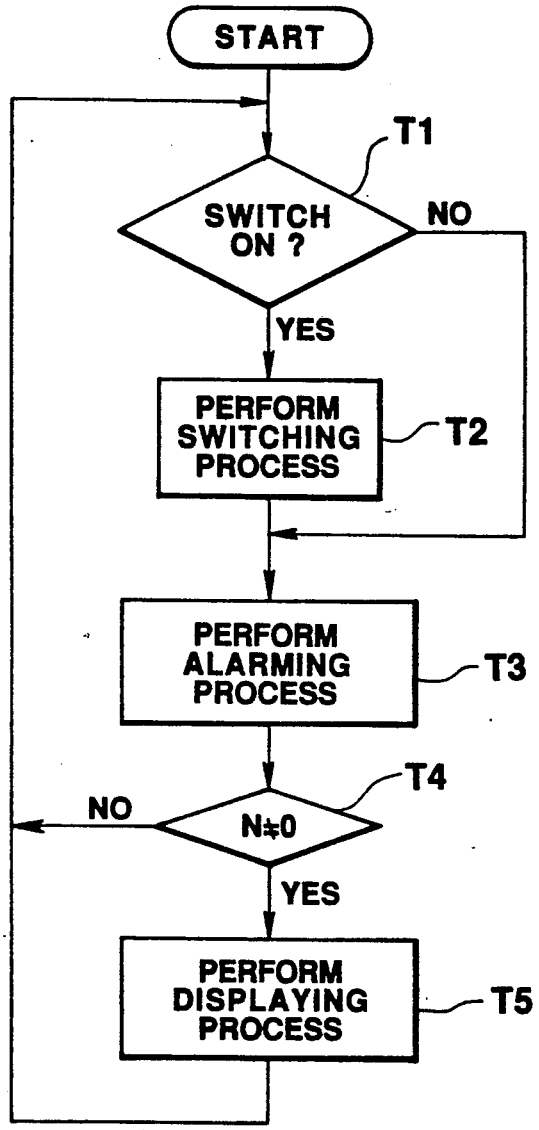
FIG. 12 is a general flow chart illustrating an action of the circuit of FIG. 11.

FIG. 12 is a general flow chart illustrating the overall action of the circuit of FIG. 11. In a step T1, the CPU 70 checks if one of the switches is depressed or not. If yes, the action proceeds to a step T2, where a process is carried out for the depressed switch and then goes to a step T3 for an alarming process. If it is determined in the step T1 that no switch is depressed, the action goes directly to the step T3 for the alarming process. In the alarming process, the CPU 70 checks if the current time T and date D transmitted from the time counting circuit 74 respectively agree with the time and date of the scheduled next alarm time stored in the alarm time register ALT. If yes, it causes the shutter plate 85 to rotate to fully expose the liquid crystal display device 60, and the scheduled alarm time is displayed on the liquid crystal display device 60 in a flashing manner. Then, in a step T4, if a number other than 0 is set in the mode register N and a mode other than a normal mode is selected or not is checked. If a number other than 0 is set in the mode register N and therefore the mode of action of the embodiment is other than the normal mode, the action proceeds to a step T5, where the CPU 70 executes a displaying process for displaying various data on the liquid crystal display device 60, and then returns to the step T1. On the other hand, if it is determined in the step T4 that the mode of action set in the mode register is the normal mode, the action directly goes back to the step T1 and follows again the same route of action.

Figure 13:
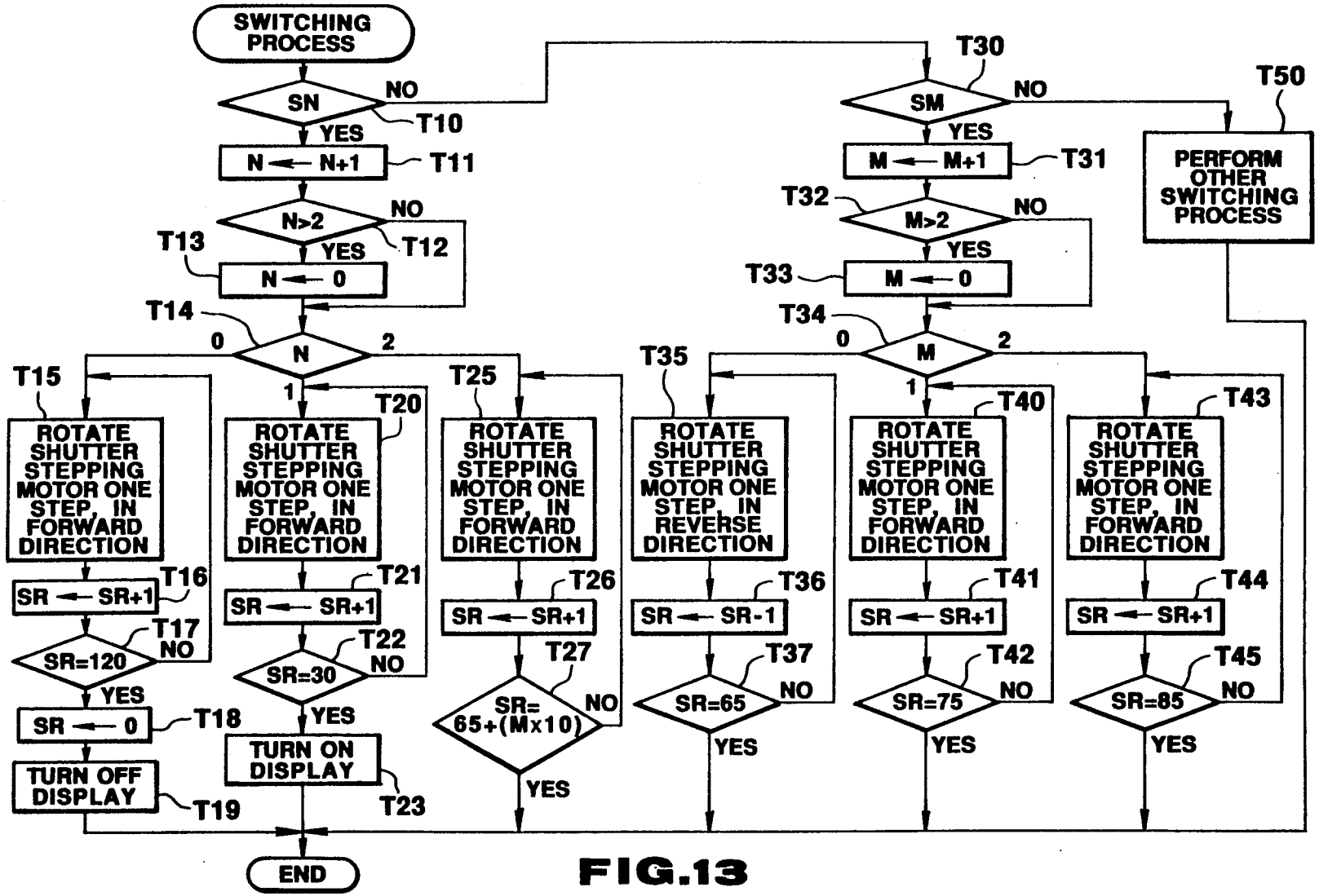
FIG. 13 is :. flow chart illustrating in detail a switching process in the flow chart of FIG. 12.
Figure 14:
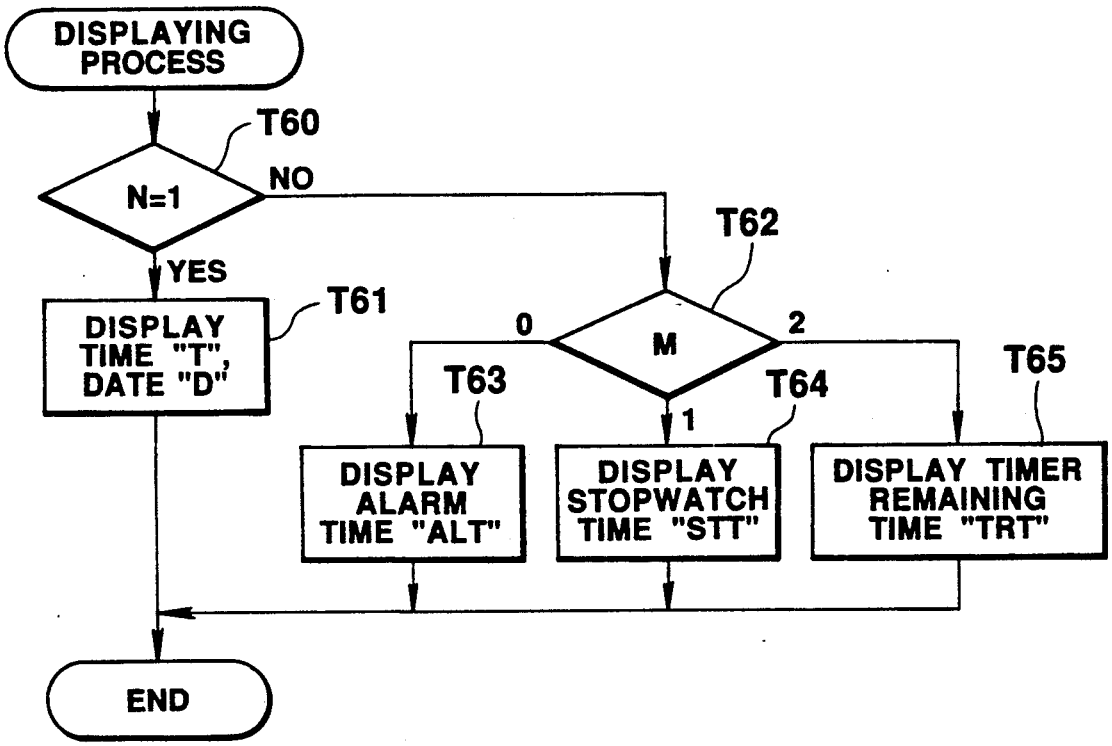
FIG. 14 is a flow chart illustrating in detail a displaying process in the flow chart of FIG. 12.

FIG. 13 is a flow chart illustrating in detail the switching process (in the step T2) in the chart of FIG. 12, and FIG. 14 is a flow chart illustrating in detail the displaying process (in the step T5) of the chart of FIG. 6. Now, these processes will be described below.

Assume that 0 is set in the mode register N to select the normal mode and 0 is set in the position register SR, so that the shutter plate 8 is located at a position as shown in FIG. 15A relative to the display window portion 57W and therefore the latter is entirely covered by the first mask portion **58*a* of the shutter plate 58. Unless one of the switches is depressed under this condition, the fact that no switch is depressed is confirmed in the step T1 and the alarming process is carried out in the step T3 as described earlier. Then in the step T4, the fact that 0 is set in the mode register N and the watch is operating in the watch mode is confirmed before the action returns to the step T1**, and the action follows again the same route.

Figure 15B:
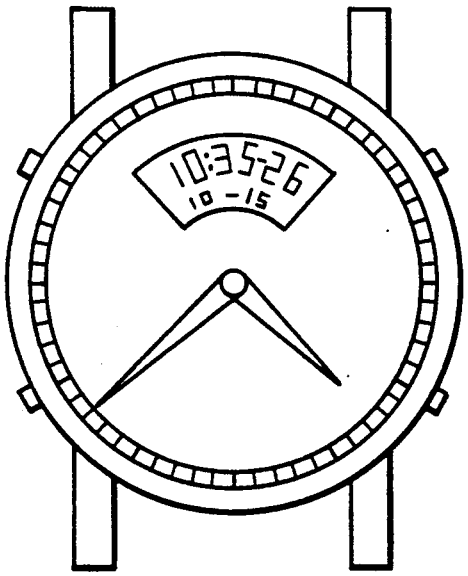
FIG. 15B is a plan view of the electronic wrist watch of FIG. 10 operating in a watch mode.

The normal mode is switched to the watch mode when the push button switch SN is depressed. Then, the action proceeds from the step T1 to the step T2 for the switching process as illustrated in FIG. 13. Referring to FIG. 13, the fact that the push button switch SN is depressed is detected in a step T10 and then, in a step T11, the value in the mode register N is increased by one to become 1 to select the watch mode. Then, in a step T12, it is determined that the value in the mode register N does not exceed 2 yet and then, in a step T14, that the value in the mode register N is now equal to 1 and the action proceed to a step T20, where the CPU 30 transmits an L signal to the motor drive circuit 83 to drive the shutter drive stepping motor 84 to rotate the latter by a given angle, which by turn rotates the shutter plate 8 in the normal direction or counterclockwise by one step. Then, in a step T21, the value stored in the position register SR is increased by one and, in a step T22, if the value of the position register SR has reached 30 or not is checked. If it is determined in the step T22 that the value in the position register SR has not reached 30 yet, the action goes back to the step T20 to repeat the processes of the steps T20 through T22 until the value in the position register SR becomes equal to 30. When the value of the position register SR has reached 30 and the shutter plate 58 has been rotated counterclockwise by 90° from the above described normal mode position to fully expose the liquid crystal display device 60 through the display window portion 57W, this condition is detected in the step T22 and the action goes to a step T23, where the CPU 70 transmits a display start signal DS to the display drive circuit 86 to set the liquid crystal display device 60 in a stand-by condition for displaying data. Thereafter, the action proceeds by way of the steps T3 and T4 of FIG. 12 to the step T5 for the displaying process as illustrated in FIG. 14. Then, in a step T60, it is determined that 1 is set in the mode register N and the watch mode is selected and, in a step S41, the current time T and the current date D obtained from the time counting circuit 74 are displayed respectively in the upper and lower half portions of the liquid crystal display device 60 before the action goes back to the step T1. If, for example, the current time and date is 10:35:26 of October 15th, the liquid crystal display device 60 will look as shown in FIG. 15B.

The watch mode is switched to the additional function mode when the push button switch SN is depressed. Upon detecting in the step T10 of FIG. 13 the fact that the push button switch SN is depressed, the value in the mode register N is increased by one to become 2 in the step T10. Then, the action proceeds by way of the step T12 to the step T14, where it is determined that the value in the mode register N is now equal to 2, and then to a step T25, where the CPU 70 transmits an L signal to the motor drive circuit 83 to make the shutter drive stepping motor 84 and therefore the shutter plate 58 rotate in the normal direction by one step. Thereafter, in a step T26, the value in the position register SR is increased by one and the action goes to a step T27, where it is determined that the value in the position register SR has not reached the value obtained by multiplying the current value of the mode register M by 10 and adding 65 to the product of the multiplication before the action goes back to the step T25. The value obtained by multiplying the current value of the mode register M by 10 and adding 65 to the product of the multiplication will be equal to 65 if the value in the mode register M is 0 and the alarm time display mode is selected. Then, the shutter plate 58 takes a position obtained by rotating it counterclockwise by 195° (65×3°) from its proper position in the normal mode. Under this condition, the letters of the alarm time display mode indicator 62 of the second mask portion 58c are displayed above the middle of the lower half of the display window portion 57W. The value of 65+(M×10) will be equal to 75 when the value in the mode register M is 1 and therefore the stopwatch mode is selected. Then, the shutter plate 58 takes a position obtained by rotating it counterclockwise by 225° (75×3°) from its proper position in the normal mode. Under this condition, the letters of the stopwatch mode indicator 61 of the second mask portion 58c are displayed above the middle of the lower half of the display window portion 57W. The value of 65+(M×10) will be equal to 85 if the value in the mode register is 2 and the timer mode is selected. Then, the shutter plate 58 takes a position obtained by rotating it counterclockwise by 225° (85×3°) from its proper position in the normal mode. Under this condition, the letters of the timer mode indicator 63 of the second mask portion 58c are displayed above the middle of the lower half of the display window portion 57W.

After the action is back to the step T25, the action of rotating the display window portion 57W counterclockwise by one step to increase the value in the mode register M by one and checking if the number of steps stored in the position register SR has become equal to the above value specified by the mode register M (the steps T25 through T27) will be repeated. When the number of the steps stored in the position register SR is found equal to the above value specified by the mode register M, it is detected in the step T27 and the action proceeds by way of the steps T3 and T4 of FIG. 12 to the step T5 for the displaying process. Then, the action goes by way of the step T60 to a step T62, where which of 0, 1 and 2 is set in the mode register M and therefore which mode is selected from the alarm time display mode of the additional function mode, the stopwatch mode or the timer mode are checked. Then, data are displayed on the liquid crystal display device 60 depending on the specified mode (steps T63 through T65). More specifically, if 0 is set in the mode register M and the alarm time display mode is specified, the action goes to the step T63, where the next scheduled time stored in the alarm time register ALT is displayed. If 1 is set in the mode register M to specify the stopwatch mode, the action proceeds to the step T64, where an elapse of time STT measured by the embodiment in the stopwatch mode and obtained from the stopwatch circuit 80 is displayed on the liquid crystal display device 60. Finally, if 2 is set in the mode register M and the timer mode is specified, the action goes to the step T65, where the remaining time TRT obtained by the subtraction timer circuit 79 is displayed on the liquid crystal display device 60. These data are shown in the upper half portion of the liquid crystal display device 60 designed to display a time and including relatively large display digits, each of which is constituted by seven-segmented display elements, while the lower half of the liquid crystal display device 60 designed to display a date and including relatively small seven-segmented display elements is covered by the second mask portion 58c of the shutter plate 58. Under this condition, the displayed data and the current mode of action can be easily recognized without misperception because the letters representing the current mode of action are always shown at the middle of the display window portion 57W, regardless if they are the letters of the alarm time display mode indicator 62, those of the stopwatch mode indicator 63 or those of the timer mode indicator 63. For instance, if 1 is set in the mode register M and the stopwatch mode is selected, the measured elapse of time STT (here, 00:00:00 because the timer mode has not started yet) is shown in the upper half portion of the liquid crystal display device 60, while the stopwatch mode indicator 61 of the second mask portion 58c of the shutter plate 58 is shown in the lower half portion of the shutter plate 58.

The current mode selected in the additional function mode, such as the alarm time display mode, the stopwatch mode or the timer mode, is switched to another mode of the additional function mode by depressing the push button switch SM.

Figure 16A:
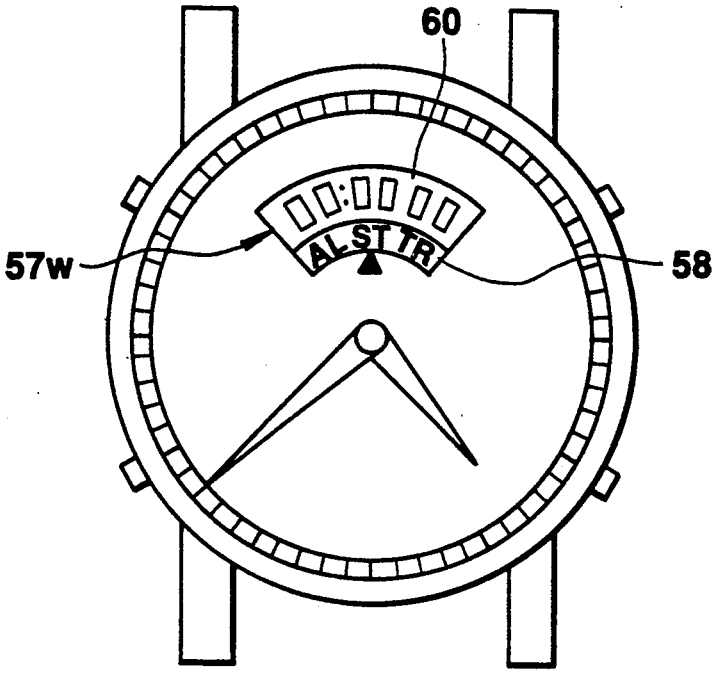
FIG. 16A is a plan view of the electronic wrist watch of FIG. 10 operating in a stopwatch mode.
Figure 16B:
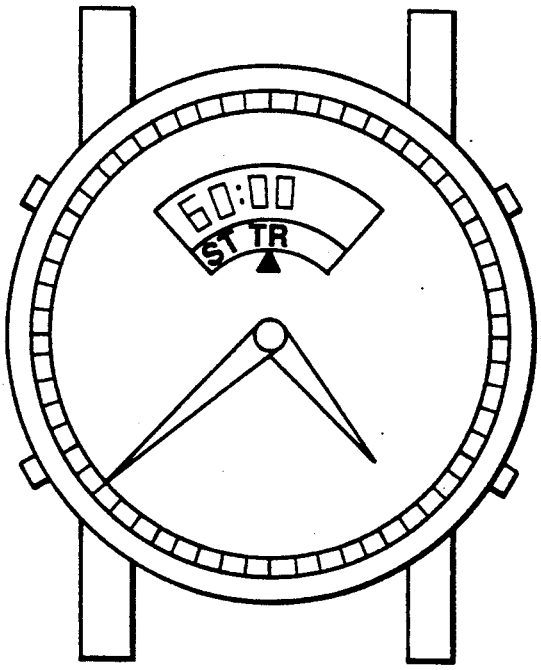
FIG. 16B is a plan view of the electronic wrist watch of FIG. 10 operating in a timer mode.

Assume that the stopwatch mode is currently selected as shown in FIG. 16A and the push button switch SM is depressed to change the stopwatch mode with the timer mode. Then, referring to FIG. 13, the fact that the push button switch SM is depressed is detected in a step T30 and the action goes to a step T31, where the value of the mode register M is increased by one to become 2 to select the timer mode. In a step T32, it is determined that the value in the mode register M does not exceed 2 and the action goes to a step T34, where the value in the mode register M is equal to 2 is determined, and thereafter the action goes to a step T43 and the following steps. Each time the procedures T34 through T45 are executed, the CPU 70 transmits an L signal to the motor drive circuit 83 to rotate counterclockwise the shutter drive stepping motor 84 and therefore the shutter plate 58 by one step to increase the value in the position register SR by one and the procedures are repeated until the value in the position register SR becomes equal to 85 and therefore the timer mode indicator 63 of the second mask portion 58c is located at the middle of the display window portion 57W. When the value in the position register SR becomes equal to 85 and the timer mode indicator 63 is located at the middle of the display window portion 57W, the action proceeds by way of the step T45 and the steps T3 and T4 of FIG. 12 to the step T62 for the displaying process (or the step T5 of FIG. 14), where that the value in the mode register M is already 2 is confirmed, and then to the step T65, where the remaining time of the timer TRT obtained from the subtraction timer circuit 79 is displayed (although it is 0 here because a time to be counted down has not set yet). Thereafter, the embodiment functions as a subtraction timer and the time to be counted down is set by using the push button switch SA in the subtraction timer circuit 79 in a step T50. A count down process is started or terminated when the push button switch SB is depressed to transmit a signal to the subtraction timer circuit 79 also in the step T50. When the current remaining time of the timer TRT is 60 minutes after the start of the count down process, the liquid crystal display device 60 will look as shown in FIG. 16B.

The timer mode is switched to the alarm time display mode in the additional function mode when the push button switch SM is depressed. Then, the depressed condition of the push button switch SM is detected in the step T30 and the value in the mode register M is increased by one to become equal to 3. In the step T32, it is determined that the value in the mode register M exceeds 2 and then the action goes to a step T33, where the value in the mode register M is returned to 0, and then to the step T34, where it is determined that 0 is set in the mode register M and the alarm time display mode is selected before the action goes to a step T35 and the following steps. Each time the procedures in the steps T35 through T37 are carried out, the CPU 70 transmits a R signal to the motor drive circuit 83 to rotate the shutter drive stepping motor 84 and therefore the shutter plate 58 clockwise or in the reverse direction by one step and decreases the value in the position register SR by one. These procedures are repeated until the step number in the position register SR becomes equal to 65 and the alarm time display mode indicator 62 of the second mask portion 58c is located at the middle of the display window portion 57W. When the step number in the position register SR is found equal to 65 and therefore the alarm time display mode indicator 62 is located at the middle of the display window portion 57W, the action goes from the step T37 by way of the steps T4 and T5 of FIG. 12 and the steps T60 and T62 of FIG. 14 to the step T63, where the alarm time stored in the alarm time register ALT is displayed on the display window portion 57W. Under this condition again, the displayed data and the current mode of action can be easily recognized without misperception because the letters representing the current mode of action, or the alarm time display mode, are always shown at the middle of the display window portion 57W.

The alarm time display mode is switched to the stopwatch mode by depressing the push button switch SM. The depressed condition of the switch is detected in the step T30 and the value in the mode register M is increased by one. Then, the action goes by way of the step T32 to the step T34, where it is determined that the value in the mode register M is already equal to 1 and the stopwatch mode is selected, before the action goes to a step T40 and the following steps.

Each time the procedures T40 through T42 are executed, the CPU 70 transmits an L signal to the motor drive circuit 83 to rotate the shutter drive stepping motor 84 and therefore the shutter plate 58 counterclockwise (in the forward direction) by one step to increase the value in the position register SR by one and the procedures are repeated until the value in the position register SR becomes equal to 75 and therefore the stopwatch mode indicator 61 of the second mask portion 58c is located at the middle of the display window portion 57W. When the value in the position register SR becomes equal to 75 and the stopwatch mode indicator 61 is located at the middle of the display window portion 57W, the action proceeds from the step T42 by way of the steps T3 and T4 of FIG. 12 and the steps T60 and T62 of FIG. 14 to the step T64, where the measured time STT obtained from the stopwatch circuit 80 is displayed on the liquid crystal display device 60. (See FIG. 16A. Note that the stopwatch measured time STT is displayed as 00:00:00 on the liquid crystal display device 60 because a time measurement has not started yet.) The time measurement is started or terminated when the push button switch SA is depressed to execute a process for starting or terminating the time measurement in the step T50 of FIG. 12.

The stopwatch mode of the additional function mode is switched back to the normal mode when the push button switch SN is depressed. The depressed condition of the push button switch SN is detected in the step T10 and the value in the mode register N is increased by one to become 3 in the step T11. Then, in the step T12, it is determined that the value in the mode register N have already exceeded 2 and the action proceeds to a step S13, where the value in the mode register N is reduced to 0 to return to the normal mode. Thereafter, that the value in the mode register N is 0 and the normal mode is selected is determined in the step T1 and the action goes to a step T15 and the following steps. Each time the procedures T15 through T17 are executed, the CPU 70 transmits an L signal to the motor drive circuit 83 to rotate the shutter drive stepping motor 84 and therefore the shutter plate 58 counterclockwise (in the forward direction) by one step to increase the value in the position register SR by one and the procedures are repeated until the step number in the position register SR becomes equal to 120 and therefore the surface of the liquid crystal display 60 is entirely covered by the first mask portion 58*a* of the shutter plate 58. When the value in the position register SR is found to be equal to 120 and the liquid crystal display device 60 is entirely covered by the first mask portion 58*a* of the shutter plate 58 as shown in FIG. 15A, the action proceeds from the step T17 to a step T18, where the value in the position register SR is reduced to 0. Then, the display stop signal DE is transmitted to the display drive circuit 86 to deactivate the liquid crystal display device 60. After deactivating the liquid crystal display device 60, the action goes by way of the steps T3 and T4 back to the step T1 of FIG. 12 to follow the same route of action for the normal mode.

It should be noted that the above embodiment may be modified in various ways without departing the scope of the present invention.

(3) 3rd Embodiment

Now, a third embodiment of the invention will be described by referring to FIGS. 17 through 24.

(a) Construction

Figure 17:
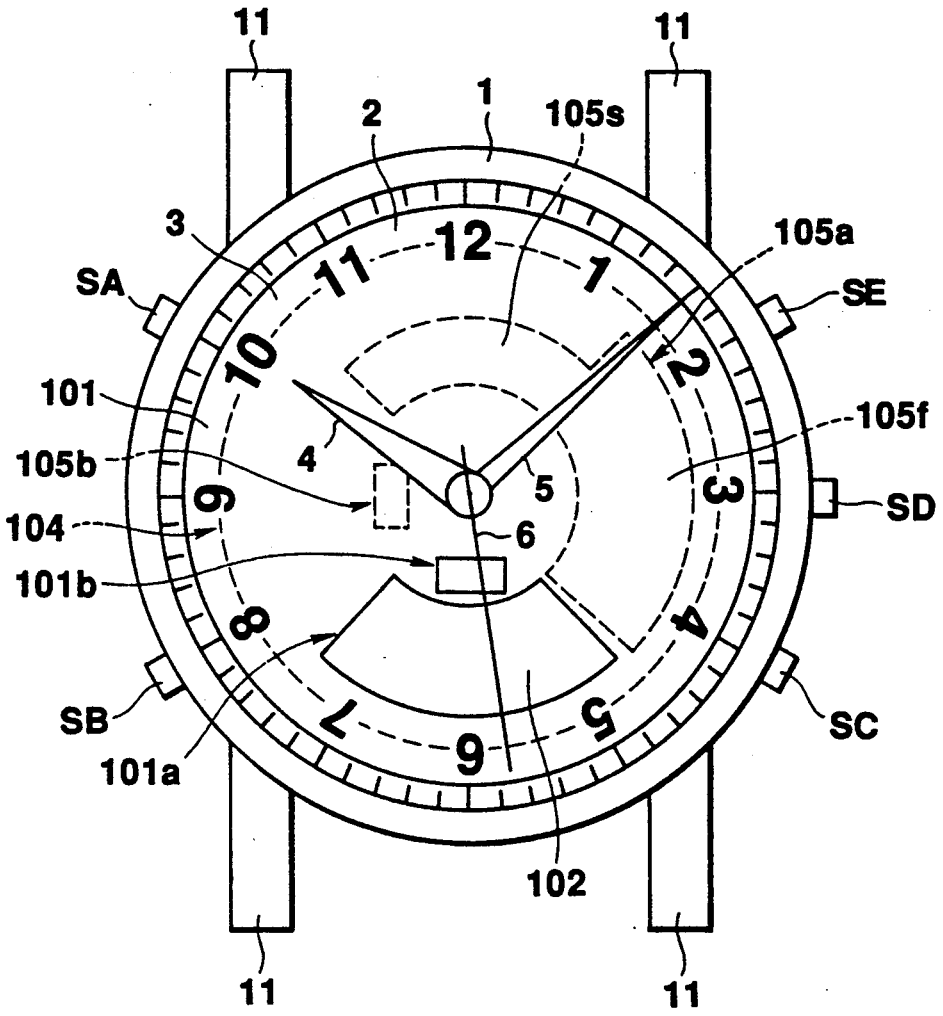
FIG. 17 is a plan view of an electronic wrist watch of a third embodiment of the invention with its opening in a dial plate being closed by a shutter plate.

FIG. 17 shows an outside view of the embodiment.

The watch case 1 has on its front surface a dial plate 101. The dial plate 101 is provided on its six o'clock line with a display window portion 101*a* realized in the form of a quadrangle produced by cutting off a sector with a central angle of 90° from a coaxial and similar but larger sector and a rectangular lighting window portion 101*b*. A lamp 103 is arranged under the lighting window portion 101*b*. A liquid crystal display panel 102 also realized in the form of a quadrangle similar to that of the display window portion 101*a* is arranged below the latter. A shutter plate 104 rotatable around the pivotal center of the hands of the embodiment is arranged between the dial plate 101 and the liquid crystal display panel 102. The shutter plate 104 is provided with a display opening portion 105*a* constituted by a first opening portion 105*f* designed to fully expose the display window portion 101*a* when it is placed exactly above the window portion 101*a*, a second display opening portion 105*s* for exposing an inner portion (or a portion close to the center of rotation of the shutter plate 104) of the display window portion 101*a* in a predetermined range when it is placed exactly above the display window portion 101*a*, and a lighting opening portion 105*b* designed to fully expose the lighting window portion 101*b* when it is placed exactly above the window portion 101*b*.

The watch case 51 is also provided with five push button switches on its outer periphery.

Figure 18:
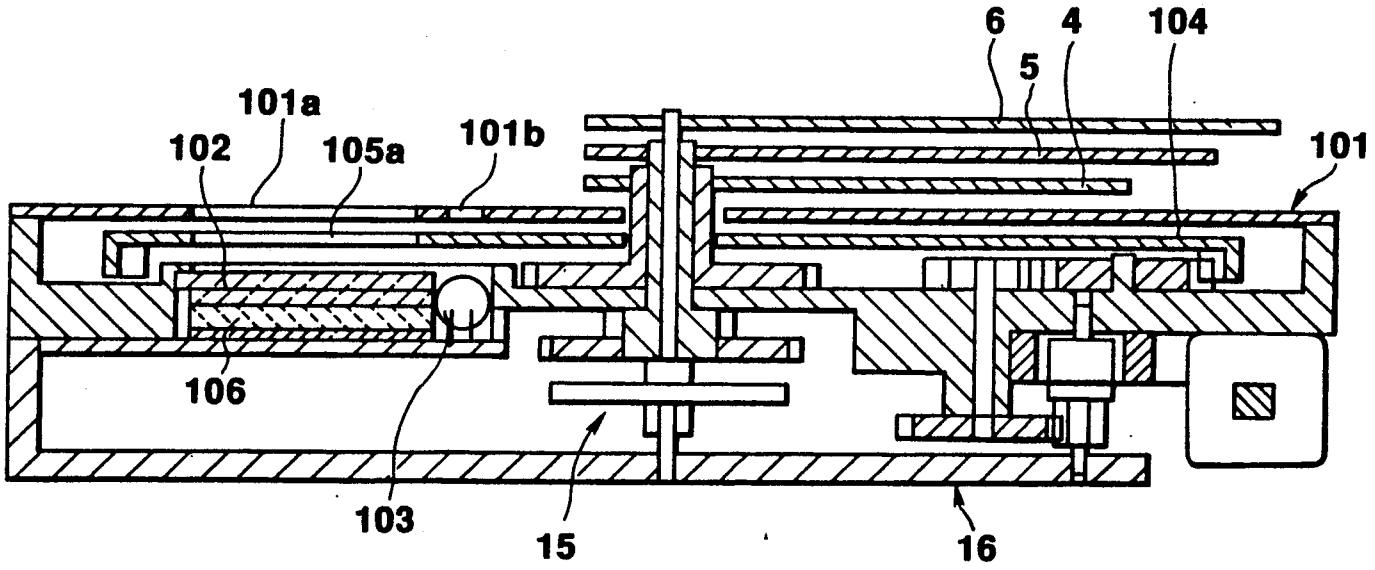
FIG. 18 is a sectional view of a main portion of the electronic wrist watch of FIG. 17.

FIG. 18 shows an analog movement of the above described third embodiment. The analog movement includes, in addition to the components of the first embodiment, the lamp 103 arranged below the dial plate 104 near the liquid crystal display panel 102 and closer to the pivotal center of the hands. Rays of light from the lamp 103 are guided to the underneath of the liquid crystal display panel 102 by way of a light diffuser panel 106 and also to the dial surface of the dial plate 101 by way of the lighting window portion 101*b* of the dial plate 101.

Figure 19:
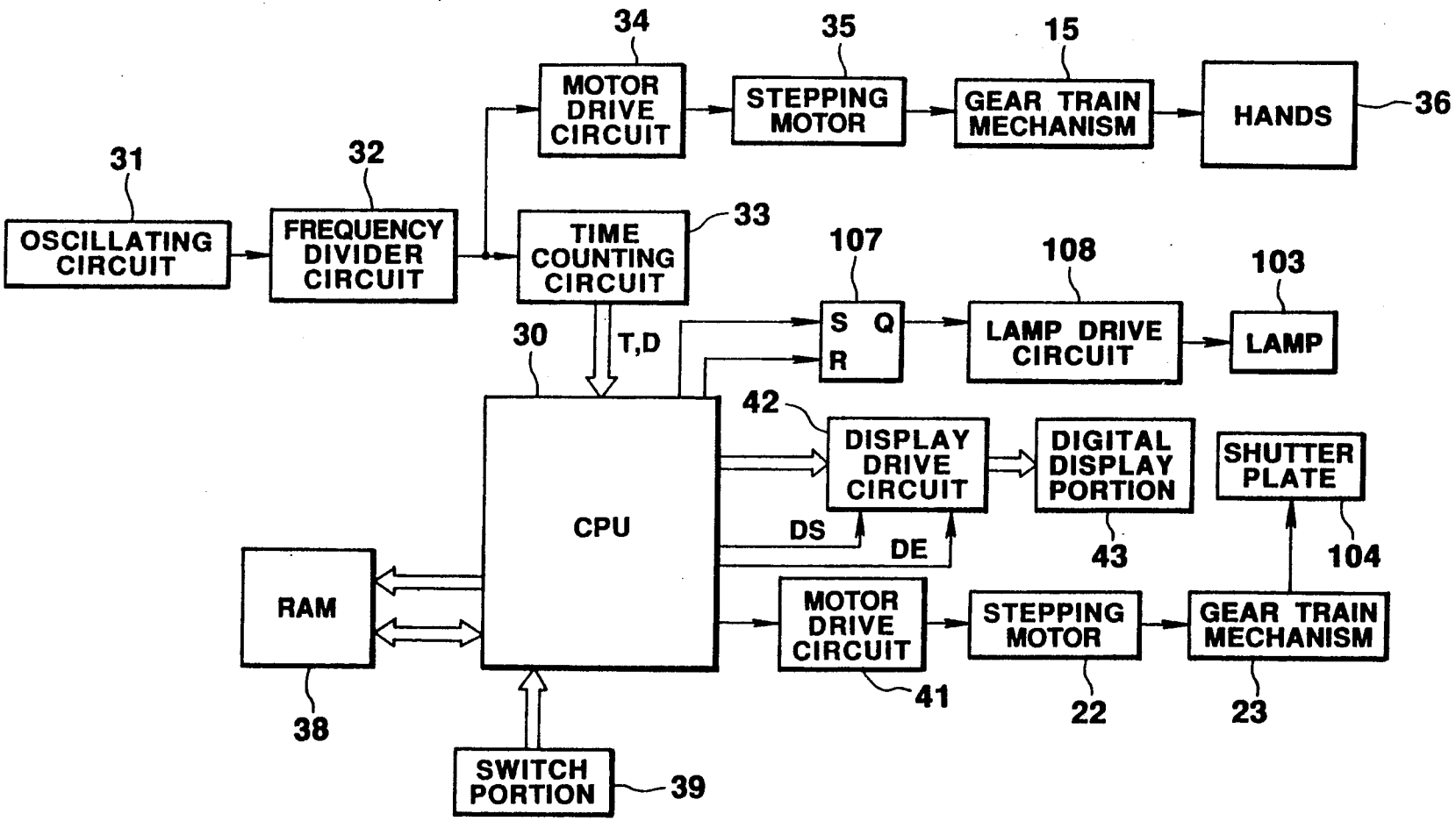
FIG. 19 is a block diagram showing a circuit construction of the electronic wrist watch of FIG. 17.

FIG. 19 is a block diagram showing the circuit construction of the embodiment of FIG. 17. It may be seen from FIG. 19 that the circuit of this third embodiment includes an RS flip-flop 107, a lamp drive circuit 108, and the lamp 103 in addition to the component of the circuit of the first embodiment. The CPU 30 transmits set and reset signals respectively to set and reset terminals S and R of the RS flip-flop 107. When the RS flip-flop receives a set signal from the CPU 30, it is brought into a set condition, where its Q output becomes "1" to activate the lamp drive circuit 108 and turn on the lamp 103, whereas it goes into a reset condition when it receives a reset signal from the CPU 30 and its Q output becomes "0" to deactivate the lamp drive circuit 108.

In this embodiment, the motor drive circuit 41 rotates the stepping motor 22 clockwise by one step to consequently rotate the shutter plate 104 clockwise by one step, or 6° (360°/60 steps), each time it receives a signal from the CPU 30.

Figure 20:
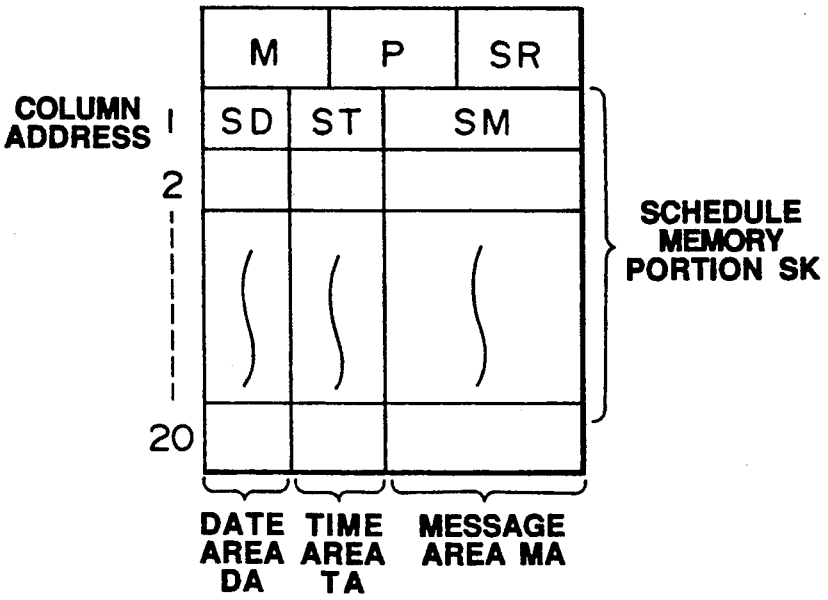
FIG. 20 is a schematic view of a construction of a RAM 38 of FIG. 17.

FIG. 20 is a schematic view of the storage area of the RAM 38. Here, the mode register M is used to specify a mode of action. When 0 is set in the mode register M, the watch operates in the watch mode so that both the display window portion 101*a* and the lighting window portion 101*b* are closed by the shutter plate 104 and only the current time is indicated by the hands 36. When 1 set in the mode register M, the watch operates in the schedule display mode, where a schedule information stored in the schedule memory SK is displayed on the liquid crystal display panel 102 in such a manner that it is visible through the first opening portion 105*f* of the shutter plate 104. When 2 is set there, the date/time display mode is specified and the current data D and the current time T are displayed in the upper portion (the portion closer to the pivotal center of the hands) of the liquid crystal display panel 102 and visible through the second opening portion 105*s* of the shutter plate 104. Finally, if 3 is set in the mode register, the watch operates in a hand lighting mode, where the display window portion 101*a* is closed by the shutter plate 104 and the lamp 103 is turned on so that rays of light emitted from the lamp 103 are guided by way of the lighting opening portion 105*b* of the shutter plate 104 and the lighting window portion 101*b* of the dial plate 101 to light the hands to make them visible and the current time indicated by them is recognizable even when it is dark.

The register P is used to specify the data to be displayed on the liquid crystal display panel 102 by means of the column address of the data stored in the schedule memory SK. The position register SR is a register in which a step value representing the current rotary position of the shutter plate 104 is set. The step value is 0 when the right edge of the first display opening portion 105*f* is aligned with the right edge of the liquid crystal display panel 102 on the 4:30 line of the dial plate (as shown in FIG. 17), and is increased by one each time the shutter plate 104 is rotated clockwise by 6°.

The schedule memory SK has 20 columns to which column addresses M1 through M20 are allocated. Each column is used to store a date (SD), a time (ST) and a message (SM) for a schedule, and includes a date area DA for storing a date, a time area for storing a time TA and a message area for storing a message. The schedules stored in the columns of the schedule memory SK are arranged in chronological order and a smaller column address is given to a schedule that takes place earlier.

(b) Action

The third embodiment having structural features as described above acts in the following manner.

Figure 21:
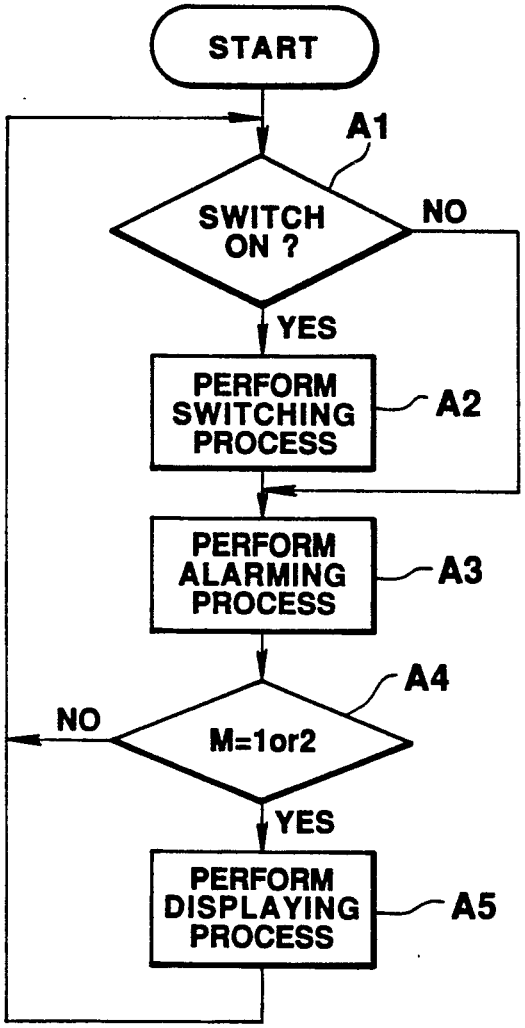
FIG. 21 is a general flow chart illustrating an action of the circuit of FIG. 19.

FIG. 21 is a general flow chart illustrating the overall action of the circuit of FIG. 19. In a step A1, the CPU 30 checks if one of the switches is depressed or not. If yes, the action proceeds to a step A2, where a process is carried out for the depressed switch and then goes to a step A3 for the alarming process. In the alarming process, the CPU 30 checks if the current time T and date D transmitted from the time counting circuit 33 agree with the time and date of the next schedule stored in the schedule memory SK. If yes, it causes the shutter plate 104 to rotate to bring the first opening portion 105*f* of the shutter plate 104 exactly under the display window portion 101*a* to fully expose the liquid crystal display panel 102 and display the message for the schedule. Then, in the step A4, if 1 or 2 is set in the mode register M and either the schedule display mode or the date display mode is selected or not are checked. If either the schedule display mode or the date display mode is selected, the action proceeds to a step A5, where it executes the displaying process for displaying appropriate data on the liquid crystal display panel 102. After carrying out the displaying process or alternatively if the current mode of action is determined in the step A4 to be neither the schedule display mode nor the date display mode, the action goes back to the step A1 and follows again the same route of action.

Figure 22:
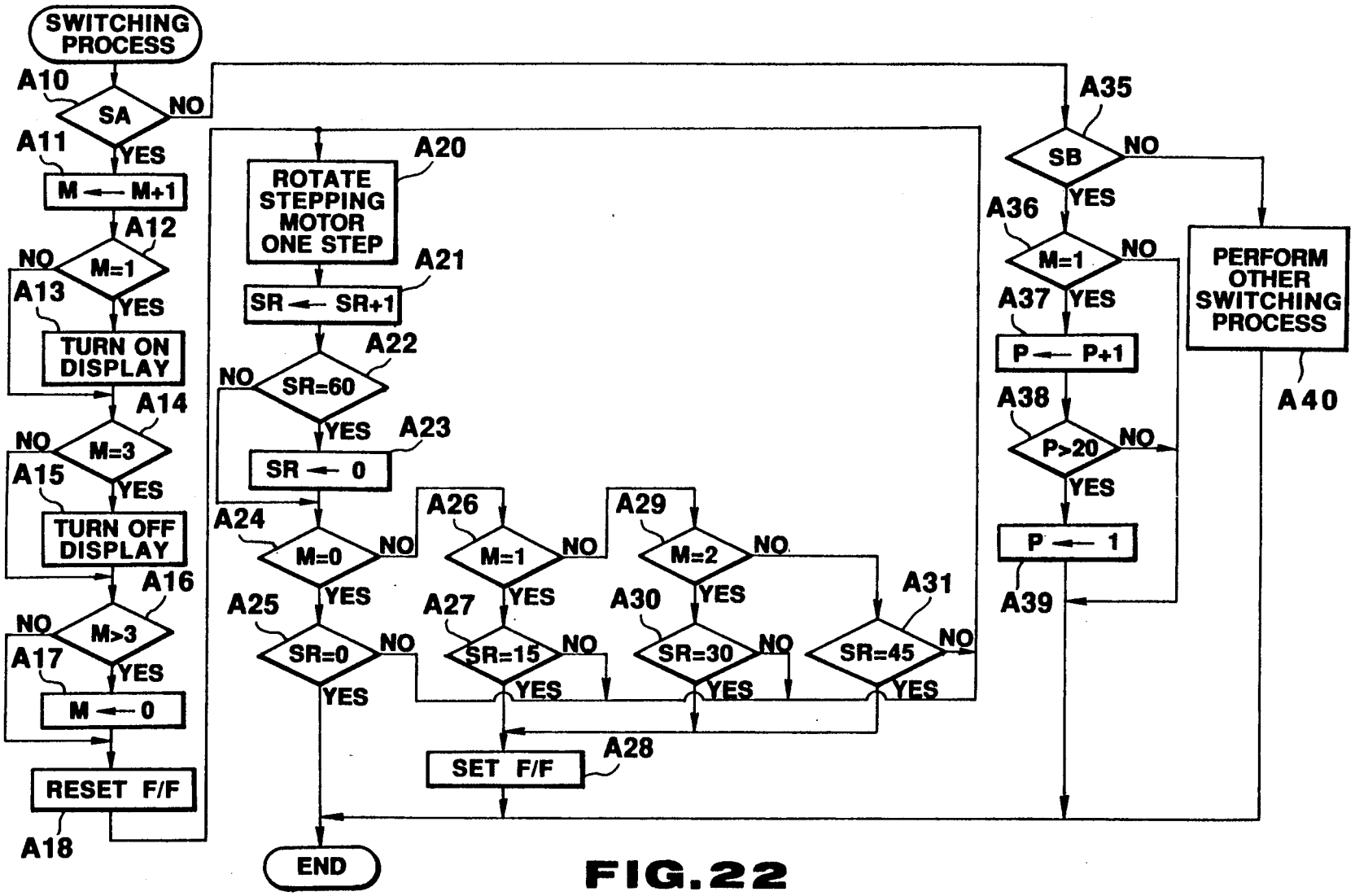
FIG. 22 is a flow chart illustrating in detail a switching process in the flow chart of FIG. 21.
Figure 23:
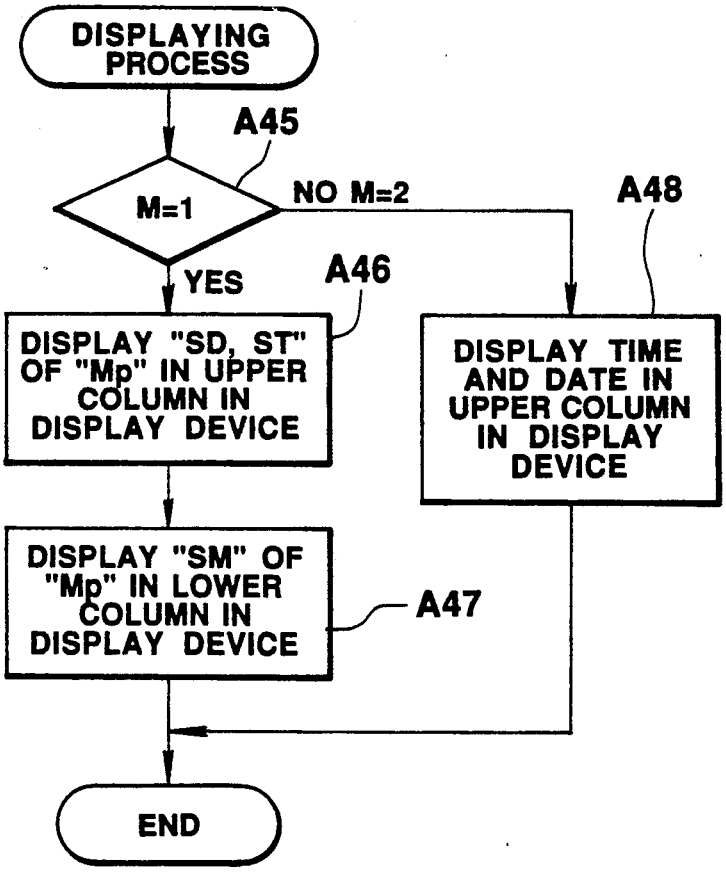
FIG. 23 is a flow chart illustrating in detail a displaying process in the flow chart of FIG. 21.

FIG. 22 is a flow chart illustrating in detail the switching process (in the step A2) in the chart of FIG. 21, and FIG. 23 is a flow chart illustrating in detail the displaying process (in the step A5) of the chart of FIG. 21. Now, these processes will be described below.

Figure 24A:
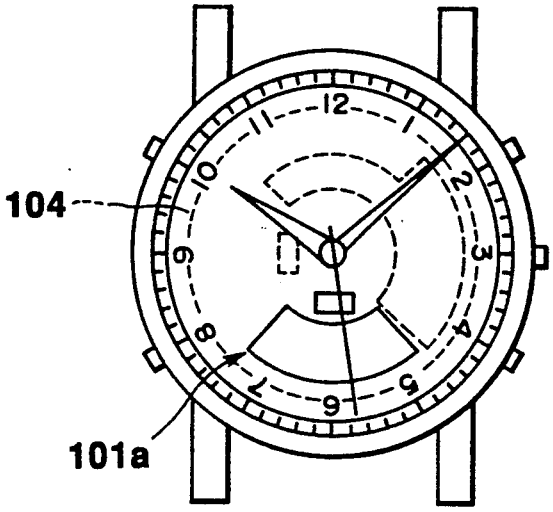
FIG. 24A is a plan view of the electronic wrist watch of FIG. 17 operating in a watch mode.

Assume that 0 is set in the mode register M to select the watch mode and 0 is set in the position register SR so that the shutter plate 104 is located in a position as shown in FIG. 24A relative to the display window portion 101*a* and therefore the latter is entirely covered by the former. Unless one of the switches is depressed under this condition, the fact that no switch is depressed is confirmed in the step A1 and the alarming process is carried out in the step A3 as described earlier. Then in the step A4, the fact that neither 1 nor 2 but 0 is set in the mode register M and the watch is operating in the watch mode is confirmed before the action returns to the step A1 and follows again the same route.

The watch mode is switched to the schedule display mode to confirm the schedule informations stored in the schedule memory SK when the push button switch SA is depressed. Then, the action proceeds from the step A1 to the step A2 for the switching process as illustrated in FIG. 22. Referring to FIG. 22, the fact that the push button switch SA is depressed is detected in a step A10 and then, in a step A11, the value in the mode register M is increased by one to become 2 to return to the schedule display mode. Then, in a step A12, that the value in the mode register M have already been equal to 1 is determined and the action proceeds to a step A13, where a display start signal DS is transmitted to the display drive circuit 42 to set the liquid crystal display panel 102 in a stand-by condition for displaying data. Thereafter in a step A14, it is determined that the value in the mode register M is not equal to 3 and then, in a step A15, that the value in the mode register M does not exceed 3 is determined. Then, in a step A18, the CPU 30 transmits a reset signal to the RS flip-flop 107 to turn off the lamp 103 if the lamp 103 have been turned on at this stage. Then, the action goes to a step A20, where the CPU 30 transmits a signal to the motor drive circuit 4 to drive the shutter drive stepping motor 22 to rotate the shutter plate 104. Consequently, the shutter plate 104 is rotated clockwise by one step (6°). Then, in a step A21, the value in the position register SR is increased by one to register the fact of rotation of the shutter plate 104 so that, in this example, the value in the position register SR becomes equal to 1. Then, in a step A22, it is determined that the value of the position register SR has not reached 60 yet. Thereafter, the action proceeds to the step A24, where it is determined that the value set in the mode register M is not equal to 0 and the mode of action of the embodiment is not the watch mode, and further to a step A26.

In the step A26, it is determined that the value in the mode register M is equal to 1 and the schedule display mode is selected. In a step A27, it is determined that the value in the position register SR is not equal to 15 yet and the action returns to the step A20. Then, the procedures of sending a signal to the motor drive circuit 41 to rotate the shutter plate 104 by one step (the steps A20 through A24, A26, and A27) and increasing the value in the position register SR by one are repeated until the value stored in the position register SR becomes equal to 15. When the value of the position register SR has reached 15 and the shutter plate 104 has angularly advanced clockwise by 90° so that the first opening portion 105*f* of the shutter plate 104 is exactly placed above the display window portion 101*a* to completely expose the liquid crystal display panel 102, this condition is detected in the step A27 and the action goes to a step A28, where the CPU 30 transmits a set signal to the RS flip-flop 107 to bring it into a set condition. Then, the "1" output Q of the RS flip-flop 107 is transmitted to the lamp drive circuit 108 so that the lamp 103 is automatically turned on before any data are displayed on the liquid crystal display panel 102. Because the lamp 103 is securely turned off in the step A18 before the shutter plate 104 is rotated and the lamp 103 is turned on again only after completion of a rotary movement of the shutter plate 104, the rotation of the shutter plate 104 is not adversely affected by any possible voltage drop of the power source battery due to energy consumption by the lamp 103.

Figure 24B:
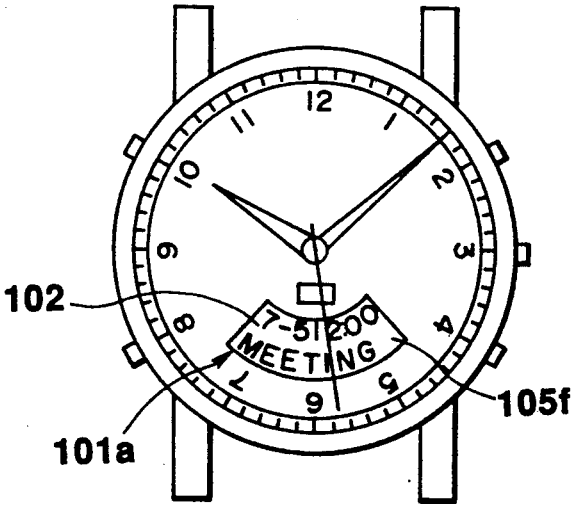
FIG. 24B is a plan view of the electronic wrist watch of FIG. 17 operating in a schedule mode.

After completion of the switching process, the action proceeds to the step A3 of FIG. 21 for the alarming process. After carrying out the alarming process in such a manner as described above, the action goes to the step A4, where it is determined that the value set in the mode register M is not equal to 1 and the schedule display mode is selected, and then goes to the step A5 for the displaying process as illustrated in FIG. 23 Then, in a step A45, it is determined that 1 is set in the mode register M and the schedule display mode is selected and, in a step A46, the scheduled date (SD) and the scheduled time (ST) of the schedule stored in the column of the schedule memory SK which is specified by the register P are displayed in the upper portion (the portion closer to the pivotal center of the hands) of the liquid crystal display panel 102. Then, in a step A47, the message (SM) for the specified schedule is displayed in the lower portion of the liquid crystal display panel 102. If the specified information is a meeting starting at twelve o'clock of July 5th, the liquid crystal display 102 which is lighted by the lamp 103 may look as shown in FIG. 24B. It should be noted that the lamp 103 is turned on in the step A28 of FIG. 22 to make the data displayed on the liquid crystal display panel 102 clearly visible and no particular switching operation is needed to light the liquid crystal display panel 102. When the displaying process is completed, the action goes back to the step A1 of FIG. 21 and follows the above described processes again.

All the scheduled informations stored in the schedule memory SK can be sequentially displayed on the liquid crystal display panel 102 for confirmation by depressing the push button switch SB. Each time the push button switch SB is depressed, the CPU 30 detects the fact in a step A35 of FIG. 22 and the action proceeds to a step A36, where it is determined that 1 is set in the mode register M and therefore the schedule mode is selected. Thereafter, the value in the register P is increased one by one from 1 to 20 (the steps A36 through A39) and the action proceeds by way of the steps A3 and A4 of FIG. 21 to the displaying process and further by way of the step A45 to the steps A46 and A47 to display the date, the time and the message of the information newly specified by the register P on the liquid crystal display panel 102.

The schedule display mode is switched to the date display mode when the push button switch SA is depressed. Then, the fact that the push button switch SA is depressed is detected in the step A10 of FIG. 22 and the action goes to a step A11, where the value in the mode register M is increased by one to become equal to 2 and then proceeds by way of the steps A12, A14 and a step A16 to the step A18, where the RS flip-flop 107 is reset to turn off the lamp 103, before the action goes to the step A20. In the step A20, the CPU 30 transmits a signal to the motor drive circuit 41 to rotate the shutter drive stepping motor 22 and therefore the shutter plate 104 by one step, and then, in the step A21, the value in the position register SR is increased by one. Thereafter, in the step A22, it is determined that the value in the position register SR has not reached 60 yet and the action goes by way of the steps A24 and A26 to a step A29, where it is determined that the date display mode is selected by the mode register M. Then, in a step A30, it is determined that the value in the position register SR has not reached 30 yet before the action returns to the step A20. Thereafter, the above procedures (the steps A20 through A22, A24, A26, A29 and A30) are repeated until the value in the position register SR becomes equal to 30. When the value in the position register SR is found to be equal to 30 and therefore the shutter plate 104 has been further rotated clockwise by 90° from the position for the schedule display mode as described above, the second display opening portion 105*s* of the shutter plate 104 is placed exactly above the display window portion 101*a* to expose only the upper portion of the liquid crystal display panel 102. This condition is detected by the CPU 30 in the step A30 and then the action goes to the step A28, where the RS flip-flop is set to turn on the lamp 103.

Figure 24C:
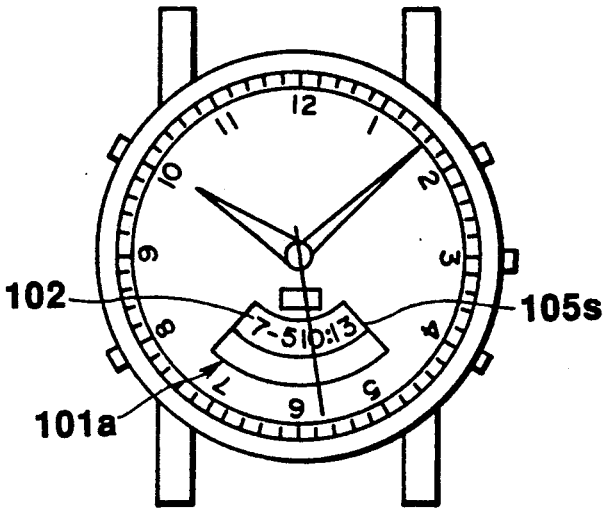
FIG. 24C is a plan view of the electronic wrist watch of FIG. 17 operating in a date/time displaying mode.
Figure 24D:
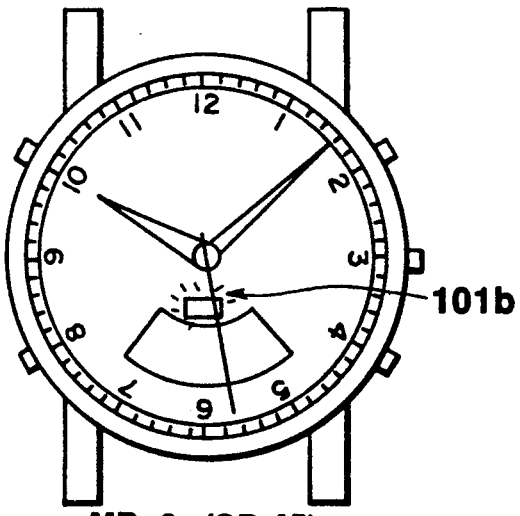
FIG. 24D is a plan view of the electronic wrist watch of FIG. 17 operating in a hand lighting mode.

Thereafter, the action goes by way of the steps A3 and A4 of FIG. 21 to the displaying process (the step S5) as illustrated in FIG. 23. There, the action goes by way of the steps S45 to S47 and a step S48, where the current date D and the current time obtained from the time counting circuit 33 are displayed on the upper portion of the liquid crystal display panel 102. If the current time and date are 10:13 of July 5th, the liquid crystal display panel 102 will look as shown in FIG. 24C.

When it is dark and the current time indicated by the hands is hardly recognizable, the hand lighting mode may be selected by depressing the push button switch SA in the date/time display mode to light the hands by the lamp 103. Then, the fact that the push button switch SA is depressed is detected in the step A10 of FIG. 22 and the action proceeds to the step A11, where the value in the mode register M is increased to become equal to 3 and select the hand lighting mode. In the step A12, it is determined that the value in the mode register M is already equal to 3 and the hand lighting mode is selected, and the action proceeds to the step A15, where the CPU 30 transmits a display stop signal DE to the display drive circuit 42 to deactivate the liquid crystal display panel 102. Then, the action goes by way of the steps A16 to A18, where the CPU 30 transmits a reset signal to the RS flip-flop 107 to reset it and turn off the lamp 103.

Thereafter, the action proceeds to the step A20, where the CPU 30 transmits a signal to the motor drive circuit 41 to rotate the shutter drive stepping motor 22 and therefore the shutter plate 104 by one step, and to the step A21, where the value in the position register SR is increased by one to become equal to 31. The action then goes by way of the steps A22, A24, A26 and A29 to A31, where it is determined that the value in the position register SR has not reached 45 yet, and returns to the step A20. The procedures (the steps A20 through A22, A24, A26, A29 and A31) are repeated until the value in the position register SR is found equal to 45 and the shutter plate 104 has been further rotated clockwise by 90° from its position for the date/time display mode as described above so that the lighting opening portion 105*b* of the shutter plate 104 is placed exactly above the lighting window portion 101*b* to expose the lamp 103. This condition is detected in a step A31 and the action goes to the step A28, where the RS flip-flop is reset to turn on the lamp 103. Consequently, rays of light emitted from the lamp 103 are guided to the hand display portion 3 by way of the lighting opening portion 105*b* and the lighting window portion 101*b* to light the hands so that the current time may be recognized even when it is very dark. After completion of the above described switching process, the action goes by way of the steps A3 and A4 to the step A1 of FIG. 21

The hand lighting mode is changed to the watch mode when the push button switch SA is depressed once again. Then, the fact that the push button switch SA is depressed is detected in the step A10 and then, in the step A11, the value in the mode register M is increased by one to become 4. Then, in the step A12, that the value in the mode register M is not equal to 1 is determined and the action proceeds to the step A14, where it is determined that the value in the mode register M is not equal to 3. The action proceeds to the step A16, where the value in the mode register M exceeds 3 and is equal to 4 and then to a step A17, where the value in the mode register M is reduced to 0 to select the watch mode. In the step A18, the RS flip-flop 107 is reset to turn off the lamp 103.

Thereafter, in the step A20, the CPU 30 transmits a signal to the motor drive circuit 41 to rotate the shutter drive stepping motor 22 and therefore the shutter plate 104 by one step, and, in the step A21, the value in the position register SR is increased by one to register the fact that the shutter plate 104 has been rotated by one step. The action then goes to the step A22, where the value in the position register SR has not reached 60 yet is determined, and to the A24, where it is determined that 0 is already set in the mode register M and therefore the watch mode is selected. Then, the action proceeds to the step A25, where it is determined that the value in the position register SR has not reached 60 yet, and returns to the step A20. The procedures (the steps A20 through A22, A24 and A25) are repeated until the value in the position register SR is found equal to 60 and the shutter plate 104 has been further rotated clockwise by 90° from its position for the hand lighting mode as described above when both the display window portion 101*a* and the lighting window portion 101*b* are completely closed by the shutter plate 104 and therefore both the liquid crystal display panel 102 and the lamp 103 are not visible any more. Then, this condition is detected in the step A22 and the action goes to a step A23, where the value in the position register SR is reduced to 0, and then to the step A24, where it is determined that the value in the mode register M is equal to 0 to select the watch mode. Then, in the step A25, it is determined that the value in the position register SR is equal to 0.

Thereafter, the action proceeds by way of the steps A3 to A4 of FIG. 21, where it is determined that the value in the mode register M is already neither 1 nor 2 but equal to 0 and the watch mode is already selected. Then, the action returns to the step A1 without proceeding further to the displaying process. Under this condition, both the display window portion 101*a* and the lighting window portion 101*b* are closed by the shutter plate 104 and the liquid crystal display panel 102 is not visible.

It should be noted that the above embodiment may be modified in various ways without departing the scope of the present invention.

While the lamp is turned on when the shutter plate starts rotating and turned off when the rotational movement of the shutter plate is terminated in the above embodiment, the lamp may be turned on intermittently so as to avoid a situation where pulse signals are being transmitted to drive the shutter plate drive stepping motor while the lamp is turned on.

Besides, while the shutter plate is rotated around the pivotal center of the hands to open or close the display window in the above embodiment, it may be alternatively moved only in a horizontal direction to open and close the window particularly when only a small window is provided.

(4) 4th Embodiment

Now, a fourth embodiment of the invention will be described by referring to FIGS. 25 through 32.

(a) Construction

Figure 25:
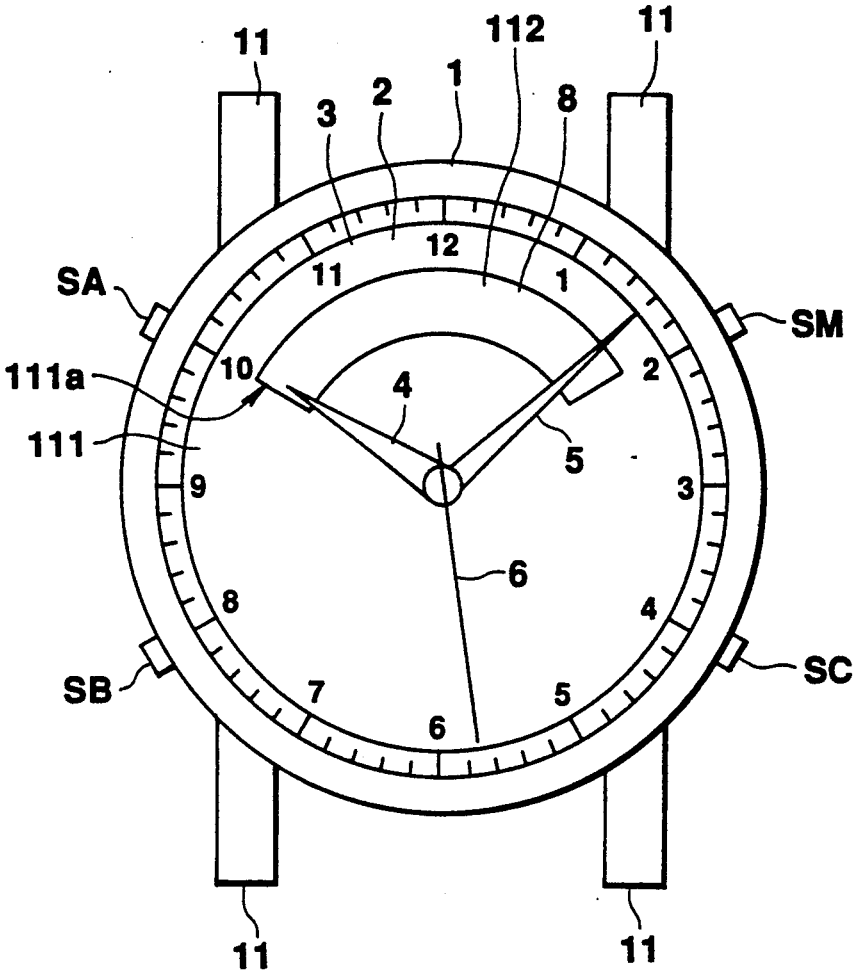
FIG. 25 is a plan view of an electronic wrist watch of a fourth embodiment of the invention with its opening in a dial pate being closed by a shutter plate.

FIG. 25 shows an outside view of the embodiment.

The dial plate 111 of the embodiment is provided on its twelve o'clock line with a display window portion 111*a* realized in the shape of a quadrangle produced by cutting off a sector with a central angle of 120° from a coaxial and similar but larger sector, the window portion being symmetrical relative to the twelve o'clock line, and a liquid crystal display panel 112 also realized in the shape of a quadrangle similar to that of the display window portion 111*a* is arranged below the latter. The watch case 1 of the embodiment is provided with four push button switches SA through SC and SM on its outer periphery.

Figure 26:
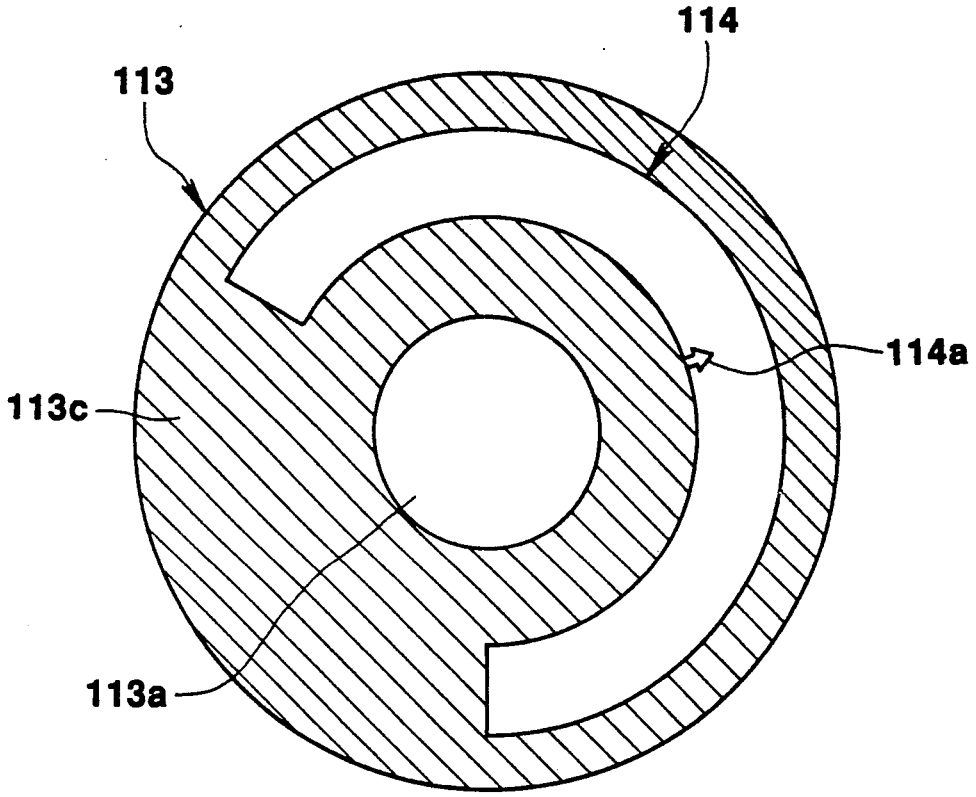
FIG. 26 is a plan view of the shutter plate of the electronic wrist watch of FIG. 25.

FIG. 26 is a plan view of the shutter plate of the embodiment of FIG. 25. Here, the shutter plate 113 is realized in the shape a disc made of transparent synthetic resin and provided at its center with a through bore 113*a* for receiving an alignment projection of the main plate of the embodiment. A mask portion 113*c* is formed on the back of the shutter plate 113 by printing, the mask portion 113*c* having a color tone identical with that of the base color of the dial plate 111 and a disc shape identical with that of the shutter plate 113 excepting for a quadrangular transparent portion 114 that can be produced by cutting off a sector with a wide central angle of 240° from a coaxial and similar but larger sector. The mask portion 113*c* has an arrow 114*a* projecting into the transparent portion 114 from the middle of the inner edge of the portion 114.

Figure 27:
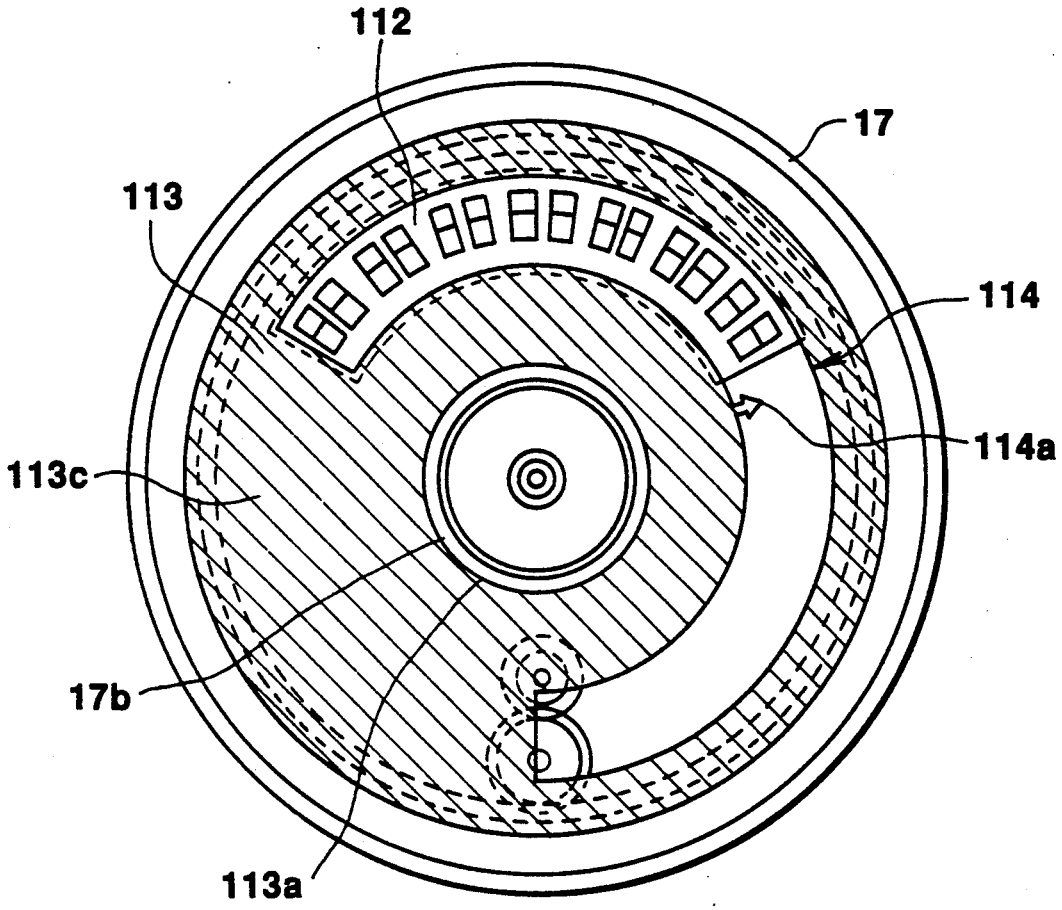
FIG. 27 is a plan view showing a relation ship between a shutter plate and a liquid crystal display panel in the electronic wrist watch of FIG. 25.

FIG. 27 is a plan view of the shutter plate 113 and a sole liquid crystal display panel 112 of the embodiment. Here, the dial plate 111 and the hands are not shown for ease of understanding the positional relationship between the liquid crystal display panel 112 and the shutter plate 113.

The liquid crystal display panel 112 is located below the locus of the transparent portion 114 and therefore becomes gradually visible through the transparent portion 114 with a particular figure or letter of the data displayed on it indicated by the arrow 114*a* as the shutter plate 113 rotates above it from a position where it totally cover the liquid crystal display panel 112 by its mask portion 113*c*. The liquid crystal display panel 112 has 7 display digits arranged on it and angularly separated from adjacent ones by 18°, each digit being constituted by 7 segmented display elements. Since the liquid crystal display panel 112 is arranged exactly below the display window portion 111*a* of the dial plate 111, the figures or letters displayed by the display digits of the liquid crystal display panel 112 are visible when the transparent portion 114 of the shutter plate 113 is located between the display window portion 111*a* and the liquid crystal display panel 112, whereas they are not visible when the mask portion 113*c* of the shutter plate 113 is located between the display window portion 111*a* and the liquid crystal display panel 112.

Figure 28:
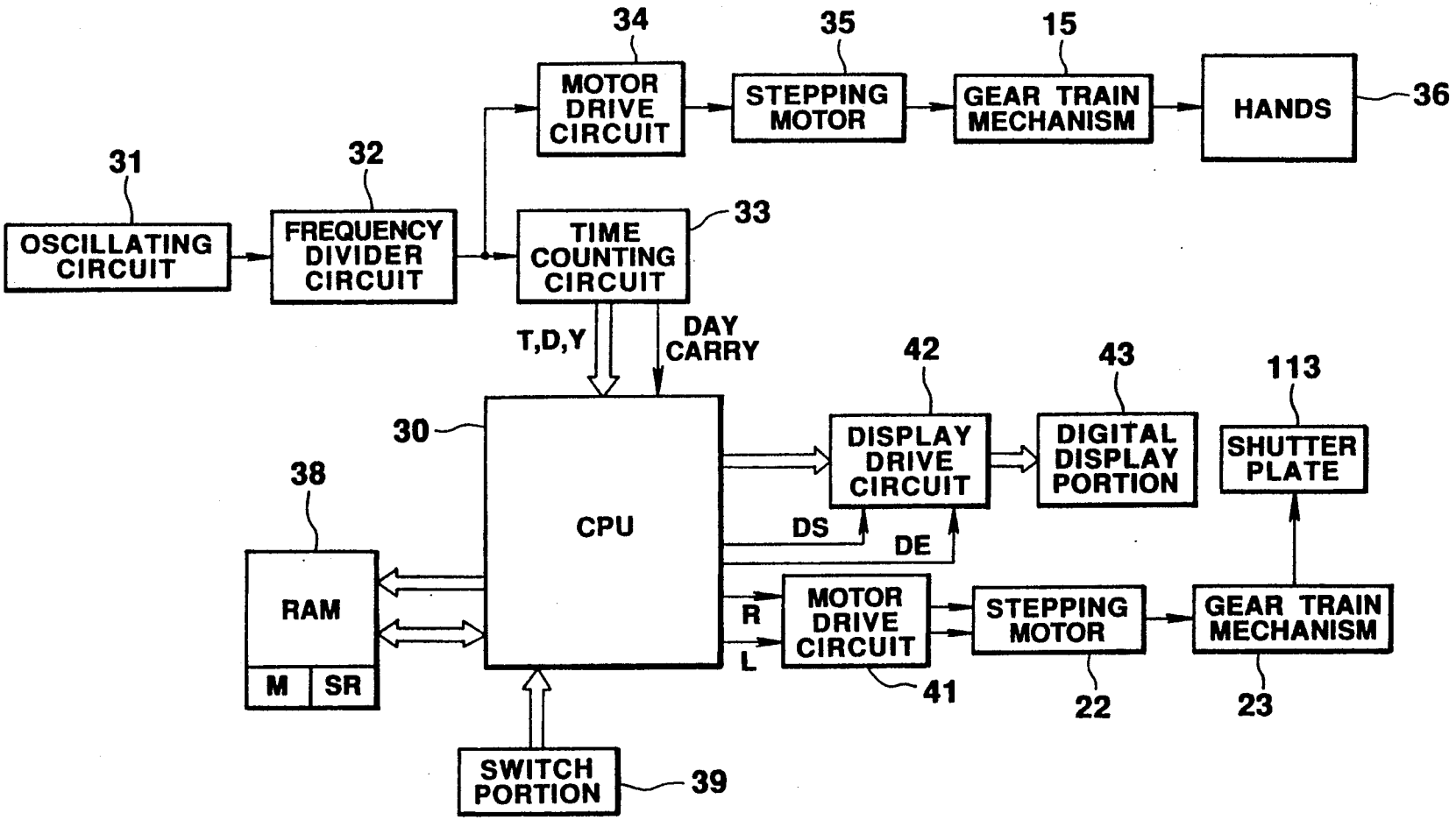
FIG. 28 is a block diagram showing a circuit construction of the electronic wrist watch of FIG. 25.

FIG. 28 is a block diagram showing the circuit configuration of the fourth embodiment of FIG. 25. Whereas the shutter plate of the first embodiment is capable of rotating only counterclockwise (forwardly), the shutter plate of this fourth embodiment can also rotate clockwise (reversely). When the CPU 30 of this embodiment transmits a counterclockwise rotation signal L to its motor drive circuit, it drives its stepping motor so as to rotate the shutter plate counterclockwise. When, on the other hand, the CPU 30 transmits a clockwise rotation signal R to the motor drive circuit, it drives the stepping motor to rotate the shutter plate clockwise.

The time counting circuit 33 generates the current time data T, the current date data D and a day of the week data Y from its counts and transmits them to the CPU 30. When the day of the week data is equal to 0, it signifies Sunday. 1 for the day of the week stands for Monday, 2 stands for Tuesday and so on, 6 standing for Saturday. Each time the time counting circuit 33 generates a new date data, it also transmits a day-carry-forward signal to the CPU 30.

The RAM 38 includes the mode register M and the position register SR. The mode register M is used to specify a mode of action. When 0 is set in the mode register M, it selects the watch mode, where the display window portion 111*a* is closed by the shutter plate 113 and the current time is indicated by the hands 36 of the embodiment. 1 set in the mode register M specifies the time display mode, where the display window portion 111*a* of the shutter plate 113 is opened to partly expose the liquid crystal display panel 112 to display the current date. Finally, 2 set in the mode register M specifies the calendar display mode, where the days of the month and the corresponding days of the week are displayed for the current week on the liquid crystal display panel 112. One of the numbers 0 through 60 is set in the position register SR to indicate the current angular or rotary position of the shutter plate 113. 0 set in the position register SR signifies that the display window portion 111*a* is completely closed by the mask portion 113*c* of the shutter plate 113 and the number in the position register SR is increased by one each time the shutter plate 113 is rotated counterclockwise (forwardly) by 6°.

(b) Action

The fourth embodiment acts in a manner as described below.

Figure 29:
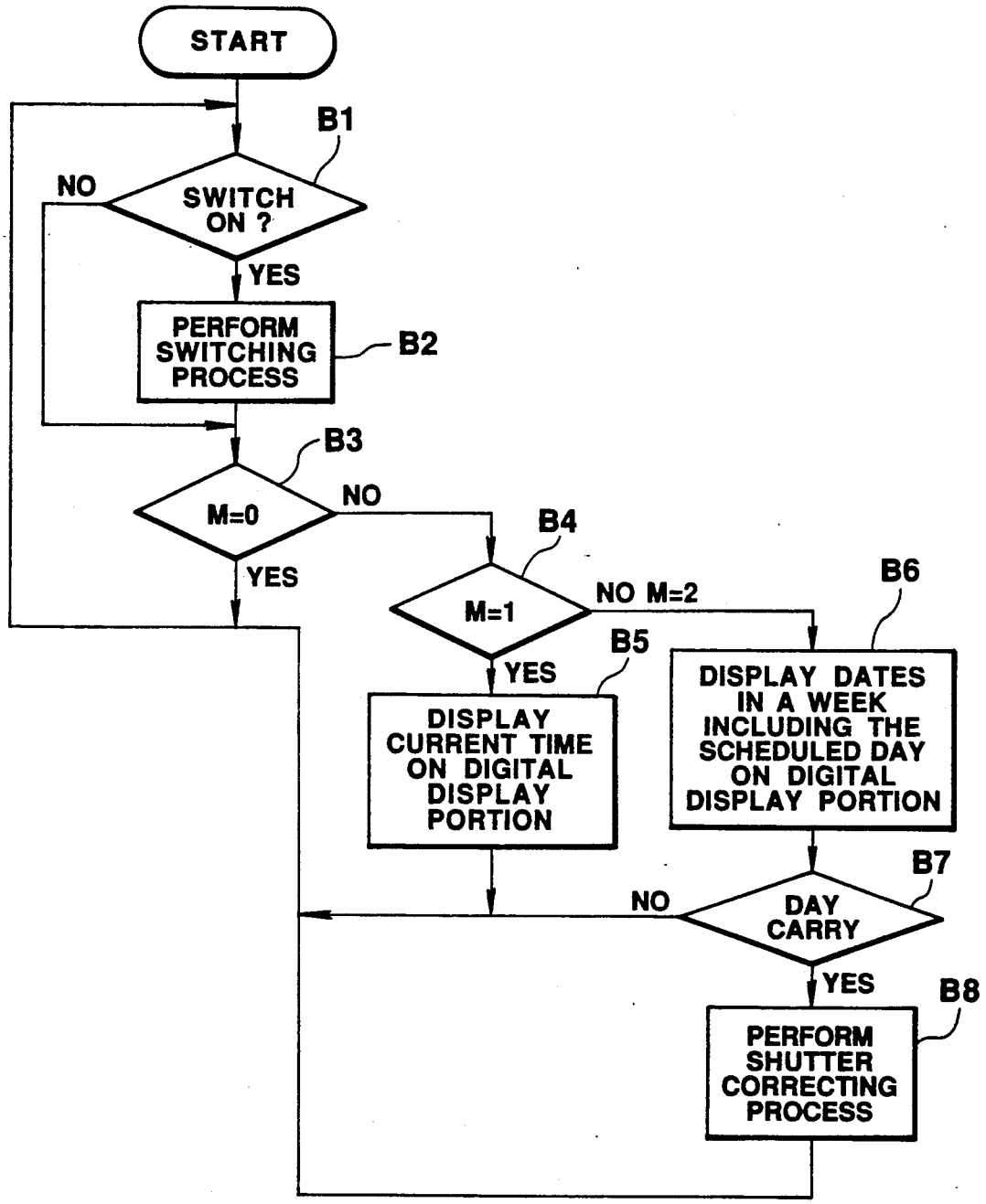
FIG. 29 is a general flow chart illustrating an action of the circuit of FIG. 28.
Figure 30:
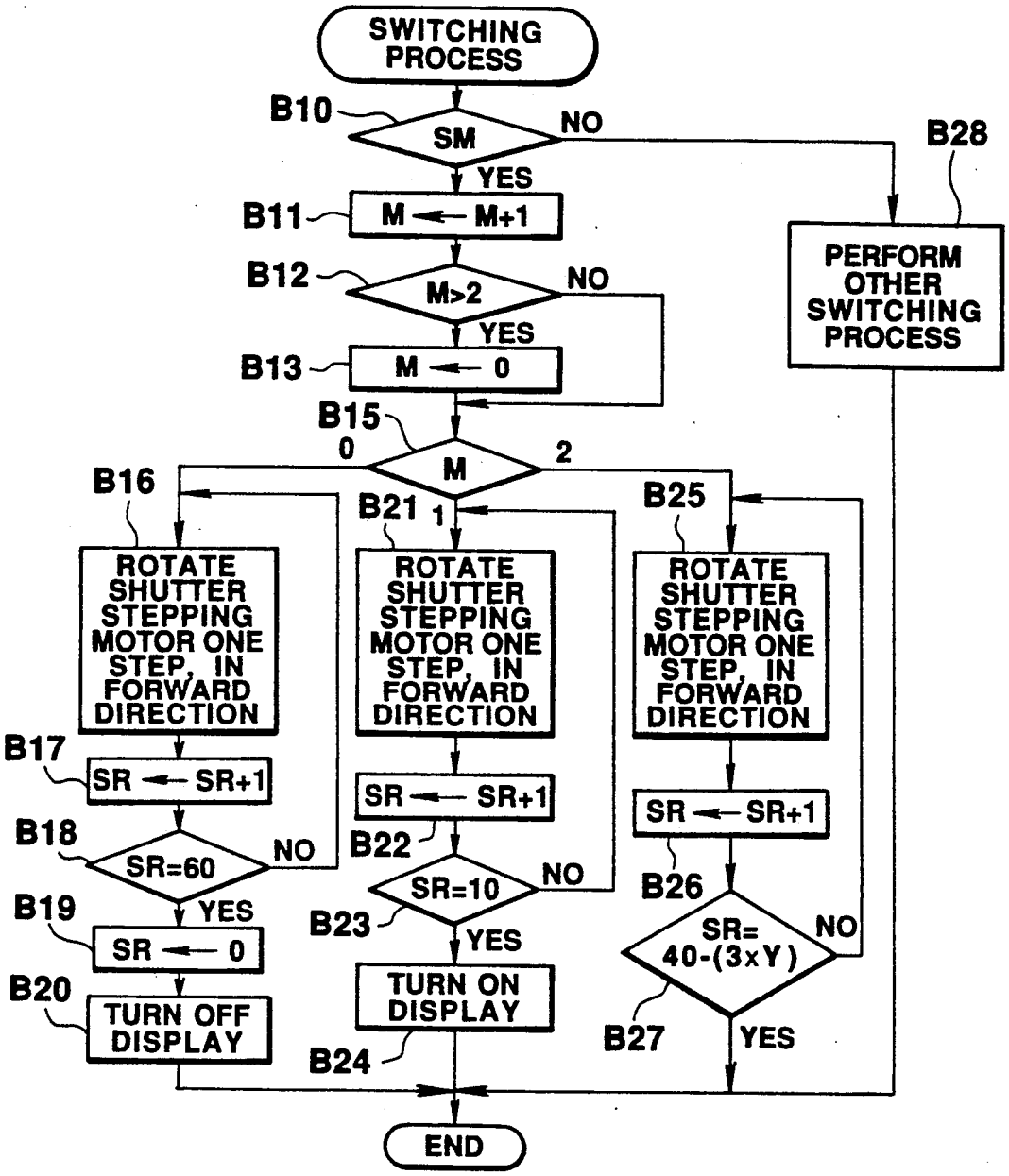
FIG. 30 is a flow chart illustrating in detail a switching process in the flow chart of FIG. 29.
Figure 31:
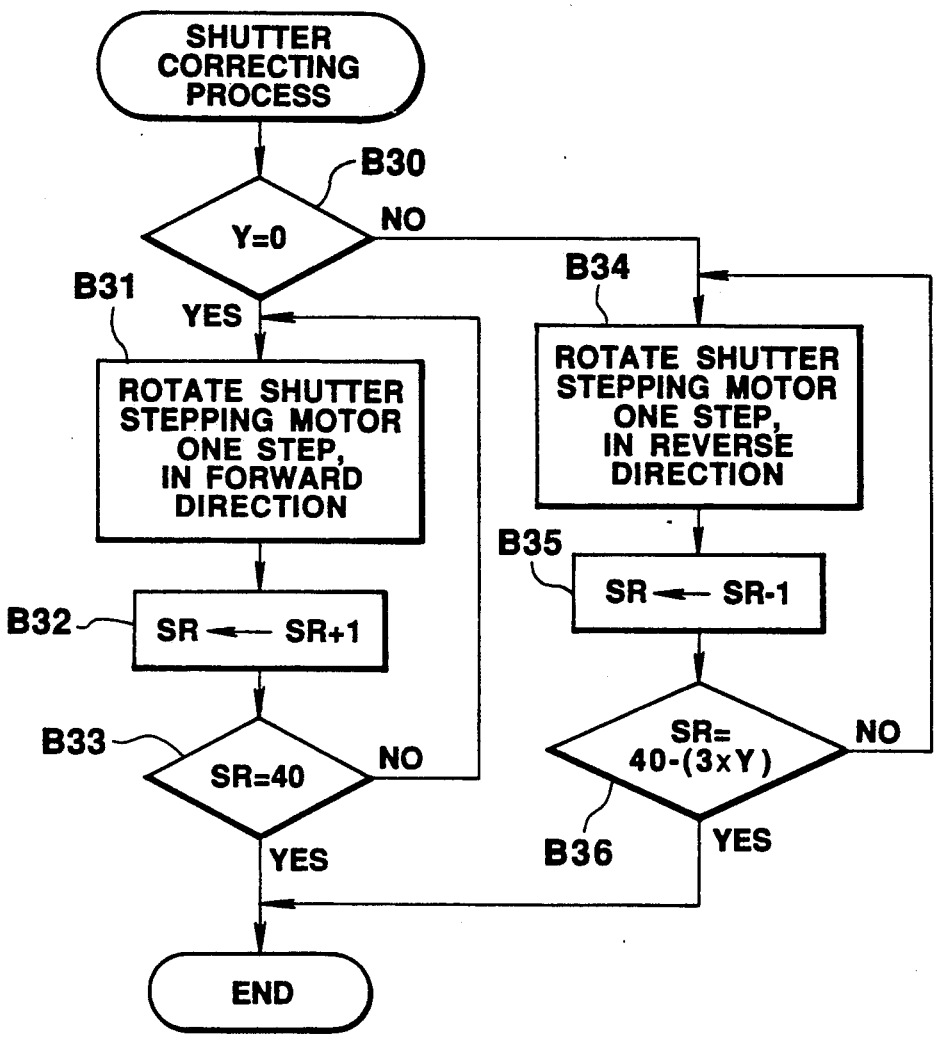
FIG. 31 is a flow chart illustrating in detail a displaying process in the flow chart of FIG. 29.

FIG. 29 is a general flow chart illustrating the overall action of the fourth embodiment FIG. 30 is a flow chart illustrating in detail the switching process (a step B2) of the chart of FIG. 29. FIG. 31 is a flow chart illustrating in detail a shutter position correcting process (a step B8) of the chart of FIG. 29. Now, the action of the embodiment will be described by referring to these illustrations.

(I) Action in the Watch Mode

Figure 32A:
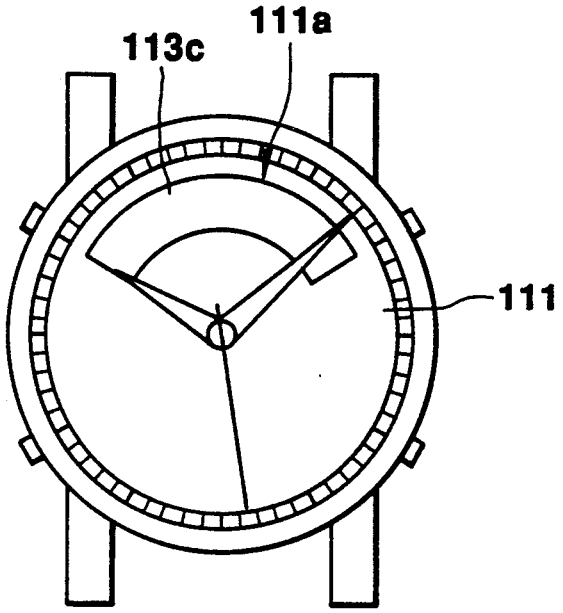
FIG. 32A is a plan view of the electronic wrist watch of FIG. 25 operating in a watch mode.

Assume that 0 is set in the mode register M to specify the watch mode and also 0 is set in the position register SR so that the display window portion 111*a* of the dial plate 111 is completely closed by the mask portion 113*c* of the shutter plate 113 as illustrated in FIG. 32A. Unless one of the switches is depressed, the fact that no switch is depressed is detected in a step B1 and then, in a step B3, it is determined that 0 is set in the mode register M and the watch mode is specified. Thereafter, the action goes back to the step B1 and follows the same processes as described above.

Figure 32B:
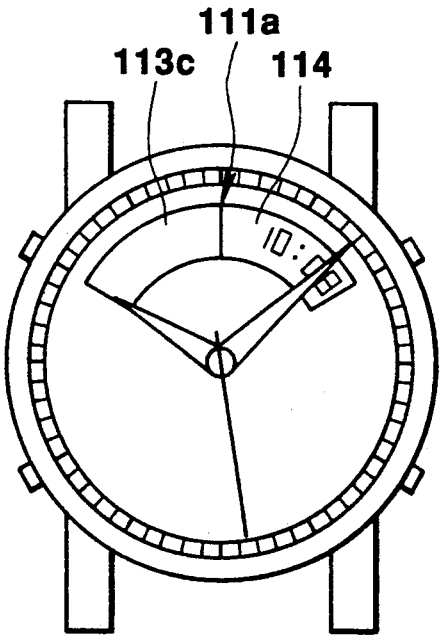
FIG. 32B is a plan view of the electronic wrist watch of FIG. 25 operating in a time displaying mode.

If, on the other hand, one of the switches is depressed, the fact that a switch is depressed is detected in the step B1 and the action goes to a switching process as illustrated in FIG. 30. In a step 30, it is checked if the depressed switch is the mode select switch SM or not. If the depressed switch is not the mode select switch SM, the action proceeds to a step B28 for a switching process corresponding to the detected condition of the switch. If, on the other hand, it is found in a step B10 that the depressed switch is the mode select switch SM, the action goes to a step B11, where the value of the mode register M which is currently 0 is increased by one to become equal to 1 to specify the time display mode. Then, in a step B12, it is determined that the value in the mode register M does not exceed 2 and the action proceeds to a step B15, where it is checked if the value in the mode register M is equal to 0, 1 or 2, or what mode is currently set in the embodiment. Now, since 1 is set in the mode register M and therefore the embodiment is operating in the time display mode, the action proceeds from the step B15 to a step B21, where the CPU 30 transmits a forward rotation signal R to the motor drive circuit 41 to rotate counterclockwise the shutter drive stepping motor 22 and therefore the shutter plate 113 by one step, or 6°. Thereafter, in a step B22, the value in the position register SR is increased by one to register the fact that the shutter plate 113 has been rotated by one step. The action then goes to a step B23, where the value in the position register SR has not reached 10 yet is determined, and returns to the B21. Then, the above procedures (the steps B21 through B23) are repeated to rotate the shutter plate 113 forwardly (counterclockwise) each time by 6° and to increase the value in the position register SR by one until the value in the position register SR is found equal to 10 and the right half of the display window portion 111*a* is covered by the transparent portion 114 of the shutter plate 113 to make the right half of the liquid crystal display panel 112 visible. When the value in the position register SR is equal to 10, this condition is detected in the step B23 and the action goes to a step B24 to activate the liquid crystal display panel 112 and then to the step B3 of FIG. 19. In the step B3, it is determined that the value in the mode register M is no longer equal to 1 and the embodiment is operating in the time display mode. Then, the action proceeds to a step B5, where the current time obtained from the time counting circuit 33 is displayed on the liquid crystal display panel 112, and returns to the step B1. If it is 10:08 now, the figures as shown in FIG. 32B are displayed on the liquid crystal display panel 112, which is visible through the display window portion 111*a* and the transparent portion 114.

(II) Action in a Calendar Display Mode

Figure 32C:
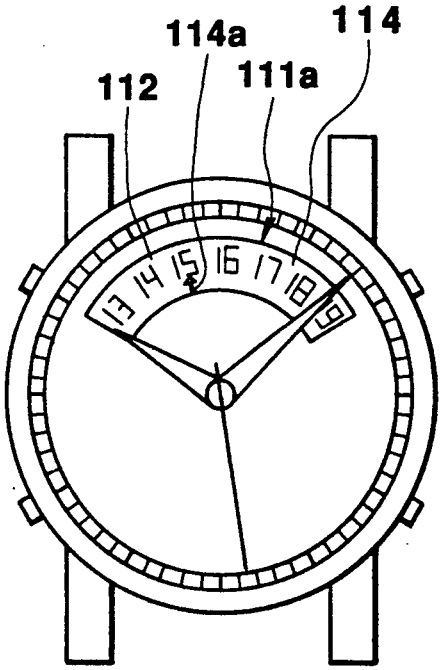
FIG. 32C is a plan view of the electronic wrist watch of FIG. 25 operating in a calendar displaying mode.

The time display mode is switched to a calendar display mode when the push button switch SM is depressed. Then, this condition is detected in the step B10 of FIG. 30 and the value in the mode register M is increased by one to become equal to 2 and specify the calendar display mode. Thereafter, the action goes to the step B12, where it is determined that the value in the mode register M does not exceed 2, and to the step B15, where it is determined that the value in the mode register M is equal to 2 and the calendar display mode is already specified, before the action goes to a step B25. In the step B25, the CPU 30 transmits a forward rotation signal R to the motor drive circuit 40 to rotate the shutter drive stepping motor 22 and therefore the shutter plate 113 by one step. Then, in a step B26, the value in the position register SR is increased by one and the action goes to a step B27 to check that the value in the position register SR is equal to $40-(3\times Y)$ or not. If not, the procedures of the steps B25 and B26 are repeated until the value in the shutter position register SR becomes equal to $40-(3\times Y)$. (Y is a number representing the current day of the week and therefore 0 if it is Sunday today, 1 if it is Monday today, . . . , and 6 if it is Saturday today.) When the value in the position register SR is equal to $40-(3\times Y)$, the arrow 114*a* is located at a position moved rightward by $(3\times Y)$ steps from the left edge of the liquid crystal display panel 112, which is a position that corresponds to 40 in the position register SR. As described earlier, when the shutter plate 113 is moved by one step, it rotates by 6°, and any two adjacent display digits of the liquid crystal display panel 112 are angularly separated from each other by 18°. Therefore, if the days of the month for Sunday (Y=0), Monday (Y=), Tuesday (Y=2), . . . , this week are serially displayed on the liquid crystal display panel 112, 40−(3×Y) in the position register SR is a number that equals to the number of steps by which the shutter plate 113 is rotated in order to make the arrow 114a indicate the current date. After completion of the switching process as described above, the action goes to the step B3 of FIG. 29, where it is determined that the value in the mode register M is not equal to 0 and therefore the watch mode is not specified, then to a step B4 to determine that the value in the mode register M is not equal to 1 and therefore the time display mode is not specified. Then, in a step B6, the days of the month for the current week are allocated to the seven display digits of the liquid crystal display panel 112. (The left end display digit shows the day of the month for Sunday of this week. The next left display digit shows the day of the month for Monday of this week and so on.) If, for instance, this week starts with the 13th and therefore the 15th is Tuesday, the liquid crystal display panel 112 will appear as shown in FIG. 32C. After completion of the above process, the action goes to a step B7, where it is checked if there is a change in the day of the month and a day-carry-forward signal has been sent from the time counting circuit 33. If not, the action returns to the step B1, whereas it goes to the step B8 for the shutter position correcting process as shown in FIG. 31 if the day-carry-forward signal has been sent from the time counting circuit 33. In the step B30 of FIG. 31, it is checked if the day of the week data Y from the time counting circuit 33 is equal to 0 and therefore a new Sunday starts or not. If the data Y is equal to 0, the action goes to a step B31, where the CPU 30 transmits a forward rotation signal R to the shutter drive stepping motor 22 to rotate the shutter plate 113 forwardly (counterclockwise) by 6°, and then to a step B32 to increase the value in the position register SR by one. Then, in a step B33, it is checked if the value in the position register SR is equal to 40 and therefore the arrow 114a of the shutter plate 113 points the day of the month for Monday or not. If the value in the position register SR is not equal to 40 yet, the procedures of the steps B31 and B32 are repeated until the value in the position register SR gets to 40. When 40 is registered in the position register SR, it is detected in the step B33 and the action goes back to the step B1 of FIG. 29. On the other hand, if it is found in the step B30 that the data Y is not equal to 0 and only a new day has come in the same week, the CPU 30 transmits a reverse rotation signal L to the shutter drive stepping motor 22 to rotate the shutter plate 113 reversely (clockwise) by one step (a step S34) and decrease the value in the position register SR by one (a step S35). Then, the procedures of the steps S34 and S35 are repeated until the value in the position register SR is found equal to 40−(3×Y) (a step Y36). Since only the data Y for the day of the week is increased by one under this condition, it may be understood that the above procedures are repeated until the value in the position register SR is decreased by 3 to rotate the shutter plate 113 reversely by 18° (which equal to the angle separating any two adjacent display digits of the liquid crystal display panel 112) and therefore make the arrow 114a point a new date for the first time after receiving the day-carry-forward signal. When, on the other hand, it is determined in the step B36 that the value in the position register SR is equal to 40−(3×Y), the action goes from the step B36 back to the step B1 of FIG. 29.

The calendar mode is switched to the watch mode when the mode select switch SM is depressed. Then, the condition that the mode select switch SM is depressed is detected in the step B10 of FIG. 30 and the value in the mode register M is increased by 1 in the step B11. In the step B12, it is determined that the value in the mode register M exceeds 2 and the action goes to a step B13 to reduce the number in the mode register M to 0 to select the watch mode. Thereafter, in the step B15, it is determined that the value in the mode register M is already equal to 0 and then the CPU 30 transmits a signal to rotate the shutter drive stepping motor 22 and therefore the shutter plate 113 forwardly by one step, or 6°, and increases the value in the position register SR by one. The above procedures (steps B16 through B18) are repeated until the value in the position register SR becomes equal to 60, when the display window portion 111a is completely closed by the mask portion 113c of the shutter plate 113 as shown in FIG. 32A. When the value of 60 in the position register SR is detected in the step B18, it is reduced to 0 in a step B19 and the action goes to a step B20 to deactivate the liquid crystal display panel 112 so that no data are displayed on the liquid crystal display panel 112 any more. Thereafter, the action goes back to the step B1.

Since the shutter plate of the fourth embodiment of the invention is made of a transparent material and covered by the mask portion excepting for a portion to be used for exposing the liquid crystal display panel, it does not need an opening as those of the preceding embodiments and therefore can be manufactured very easily at a very low cost.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An analog electronic timepiece having an electric-optical display device, comprising:

a dial plate in which an opening is formed;

time-indicating hand means for pivotally moving hands on said dial plate to indicate the time;

electric-optical display means arranged below the opening of said dial plate;

a shutter plate mounted between said dial plate and said electric-optical display means;

data generating means for generating at least two different types of data which require the different numbers of display digits to be used to display them on said electric-optical display means;

display control means for selectively displaying the two types of data generated by said data generating means on said electric-optical display means; and shutter plate movement control means for moving said shutter plate to a first position, in which only one data is exposed through the opening of said dial plate, and stopping it at the first position when one of the two types of data is displayed on said electric-optical display means by said display control means, and for moving said shutter plate to a second position, in which only the other data is exposed through the opening of said dial plate, and stopping it at the second position when the other type of data is displayed on said electric-optical display means.

2. An analog electronic timepiece having an electric-optical display device according to claim 1, wherein said shutter plate rotates around a pivotal center of said hands.

3. An analog electronic timepiece having an electric-optical display device according to claim 1, wherein the opening of said dial plate has a circular-arc shape, said shutter plate is rotatable around a pivotal center of said hands and is provided with a circular-arc shaped opening having substantially the same central angle as that of the opening of said dial plate, and the opening of said shutter plate corresponds to the opening of said dial plate to fully open the opening of said dial plate when the above described one of the two types of data is displayed on said electric-optical display means by said display control means, and the opening of said shutter plate partly corresponds to the opening of said dial plate to partly open the opening of said dial plate when the other of the two types of data is displayed on said electric-optical display means by said display control means.

4. An analog electronic timepiece having an electric-optical display device according to claim 1, wherein the opening of said dial plate has a circular-arc shape, and said shutter plate is rotatable around a pivotal center of said hands and has a first portion, the radius of the outer periphery of which is smaller than the radius of the inner periphery of the opening, and a second portion, the radius of the outer periphery of which is smaller than the radius of the outer periphery of the opening but greater than the radius of the inner periphery of the opening.

5. An analog electronic timepiece having an electric-optical display device according to claim 1, wherein said timepiece further comprises:

lighting means, arranged near to said electric-optical display means, for lighting said electric-optical display means; and lighting drive control means for driving said lighting means when said shutter plate is moved by said shutter plate movement control means to open the opening of said dial plate.

6. An analog electronic timepiece having an electric-optical display device according to claim 1, wherein said shutter plate is formed by a transparent member, and a mask portion is formed in said transparent member to cover the opening of said dial plate.

7. An analog electronic timepiece having an electric-optical display device, comprising:

a dial plate in which an opening is formed;

time-indicating hand means for pivotally moving hands on said dial plate to indicate the time;

electric-optical display means arranged below the opening of said dial plate;

a shutter plate mounted between said dial plate and said electric-optical display means;

data generating means for generating at least two different types of data which require the different numbers of display digits to be used to display them on said electric-optical display means;

first display control means for selectively displaying the two types of data generated by said data generating means on said electric-optical display means;

second display control means for terminating the data display on said electric-optical display means; and shutter plate movement control means for moving said shutter plate to a first position, in which only one data is exposed through the opening of said dial plate, and stopping it at the first position when one of the two types of data is displayed on said electric-optical display means by said first display control means, for moving said shutter plate to a second position, in which only the other data is exposed through the opening of said dial plate, and stopping it at the second position when the other type of data is displayed on said electric-optical display means also by said first display control means, and for moving said shutter plate to a third position to completely close the opening of said dial plate and stopping it at the third position when the data display on said electric-optical display means is terminated by said second display control means.

8. An analog electronic timepiece having an electric-optical display device according to claim 7, wherein said shutter plate rotates around a pivotal center of said hands.

9. An analog electronic timepiece having an electric-optical display device according to claim 7, wherein the opening of said dial plate has a circular-arc shape, said shutter plate is rotatable around a pivotal center of said hands and is provided with a circular-arc shaped opening having substantially the same central angle as that of the opening of said dial plate, the opening of said shutter plate corresponds to the opening of said dial plate to fully open the opening of said dial plate when the above described one of the two types of data is displayed on said electric-optical display means by said first display control means, and the opening of said shutter plate partly corresponds to the opening of said dial plate to partly open the opening of said dial plate when the other of the two types of data is displayed on said electric-optical display means by said first display control means.

10. An analog electronic timepiece having an electric-optical display device according to claim 7, wherein the opening of said dial plate has a circular-arc shape, and said shutter plate is rotatable around a pivotal center of said hands and has a first portion, the radius of the outer periphery of which is smaller than the radius of the inner periphery of the opening, a second portion, the radius of the outer periphery of which is greater than the radius of the outer periphery of the opening, and a third portion, the radius of the outer periphery of which is greater than the radius of the inner periphery of the opening but smaller than the radius of the outer periphery of the opening.

11. An analog electronic timepiece having an electric-optical display device according to claim 7, wherein said timepiece further comprises:

lighting means, arranged near to said electric-optical display means, for lighting said electric-optical display means; and lighting drive control means for driving said lighting means when said shutter plate is moved by said shutter plate movement control means to open the opening of said dial plate.

12. An analog electronic timepiece having an electric-optical display device according to claim 7, wherein said shutter plate is formed by a transparent member, and a mask portion is formed in said transparent member to cover the opening of said dial plate.

13. An analog electronic timepiece having an electric-optical display device comprising:

a dial plate in which an opening is formed;

time-indicating hand means for pivotally moving hands on said dial plate to indicate the time;

electric-optical display means arranged below the opening of said dial plate;

data generating means for generating at least two types of first and second data which require the different numbers of display digits to be used to display them on said electric-optical display means;

display control means for selectively displaying the two types of data generated by said data generating means on said electric-optical display means;

a shutter plate movably mounted between said dial plate and said electric-optical display means;

function indicators, formed on said shutter plate, for indicating the function of the second data; and shutter plate movement control means for moving said shutter plate to a first position, in which only the first data is exposed through the opening of said dial plate, and stopping it at the first position when the first data of the two types of data is displayed on said electric-optical display means by said display control means, and for moving said shutter plate to a second position, in which only the second data and said function indicators are exposed through the opening of said dial plate, and stopping it at the second position when the second data is displayed on said electric-optical display means.

14. An analog electronic timepiece having an electric-optical display device according to claim 13, wherein said shutter plate rotates around a pivotal center of said hands.

15. An analog electronic timepiece having an electric-optical display device according to claim 13, wherein the opening of said dial plate has a circular-arc shape, and said shutter plate is rotatable around the pivotal center of said hands and it provided with a first portion, the radius of the outer periphery of which is smaller than the radius of the inner periphery of the opening, and a second portion, the radius of the outer periphery which is smaller than the radius of the outer periphery of the opening but greater than the radius of the inner periphery the opening, said function indicators being formed on a portion of said second portion located outside of the inner periphery of the opening.

16. An analog electronic timepiece having an electric-optical display device according to claim 13, wherein said timepiece further comprises:

lighting means, arranged near to said electric-optical display means, for lighting said electric-optical display means; and lighting drive control means for driving said lighting means when said shutter plate is moved by said shutter plate movement control means to open the opening of said dial plate.

17. An analog electronic timepiece having an electric-optical display device according to claim 13, wherein said shutter plate is formed by a transparent member, and a mask portion for covering the opening of said dial plate and said function indicators is formed in said transparent member.

18. An analog electronic timepiece having an electric-optical display device comprising:

a dial plate in which an opening is formed;

time-indicating hand means for pivotally moving hands on said dial plate to indicate the time;

electric-optical display means arranged below the opening of said dial plate;

data generating means for generating at least two types of first and second data which require the different numbers of display digits to be used to display them on said electric-optical display means;

first display control means for selectively displaying the two types of data generated by said data generating means on said electric-optical display means;

second display control means for terminating the data display on said electric-optical display means;

a shutter plate movably mounted between said dial plate and said electric-optical display means;

function indicators, formed on said shutter plate, for indicating the function of the second data; and shutter plate movement control means for moving said shutter plate to a first position, in which only the first data is exposed through the opening of said dial plate, and stopping it at the first position when the first data of the two types of data is displayed on said electric-optical display means by said first display control means, for moving said shutter plate to a second position, in which only the second data and said function indicators are exposed through the opening of said dial plate, and stopping it at the second position when the second data in the two-types data is displayed on said electric-optical display means, and for moving said shutter plate to a third position, in which the opening of said dial plate is completely closed, and stopping it at the third position when the data display on said electric-optical display means is terminated by said second display control means.

19. An analog electronic timepiece having an electric-optical display device according to claim 18, wherein said shutter plate rotates around a pivotal center of said hands.

20. An analog electronic timepiece having an electric-optical display device according to claim 18, wherein the opening of said dial plate has a circular-arc shape, and said shutter plate is rotatable around a pivotal center of said hands and is provided with a first portion, the radius of the outer periphery of which is smaller than the radius of the inner periphery of the opening, a second portion, the radius of the outer periphery of which is greater than the radius of the outer periphery of the opening, and a third portion, the radius of the outer periphery of which is greater than the radius of the inner periphery of the opening but smaller than the radius of the outer periphery of the opening, said function indicators being formed on a portion of said third portion located outside of the inner periphery of the opening.

21. An analog electronic timepiece having an electric-optical display device according to claim 18, wherein said timepiece further comprises:

lighting means, arranged near to said electric-optical display means, for lighting said electric-optical display means, and lighting drive control means for driving said lighting means when said shutter plate is moved by said shutter plate movement control means to open the opening of said dial plate.

22. An analog electronic timepiece having an electric-optical display device according to claim 18, wherein said shutter plate is formed by a transparent member, and a mask portion for covering the opening of said dial plate and said function indicators is formed in said transparent member.

23. An analog electronic timepiece having an electric-optical display device comprising:

a dial plate in which an opening is formed;

time-indicating hand means for pivotally moving hands on said dial plate to indicate the time;

electric-optical display means arranged below the opening of said dial plate, and provided with a plurality of display digits for displaying a plurality of character data;

a shutter plate movably mounted between said dial plate and said electric-optical display means;

data generating means for generating at least a first data consisting of plurality of character data and a second data consisting of character data, the number of which is smaller than that of the first data;

display control means for selectively displaying the two types of data generated by said data generating means on said electric-optical display means; and shutter plate movement control means for moving said shutter plate to a first position, in which all the display digits of the electric-optical display means are exposed, and stopping it at the first position when the first data is displayed on said electric-optical display means by said display control means, and for moving said shutter plate to a second position, in which only the display digits of the electric-optical display means showing the second data are exposed, and stopping it at the second position when the second data is displayed on said electric-optical display means, the number of the second-data displaying digits being smaller than the total number of the display digits.

24. An analog electronic timepiece having an electric-optical display device according to claim 23, wherein said shutter plate rotates around a pivotal center of said hands.

25. An analog electronic timepiece having an electric-optical display device according to claim 23, wherein the opening of said dial plate has a circular-arc shape, said shutter plate is rotatable around a pivotal center of said hands and is provided with a circular-arc shaped opening having substantially the same central angle as that of the opening of said dial plate, and the opening of said shutter plate corresponds to the opening of said dial plate to fully open the opening of said dial plate when the first data is displayed on said electric-optical display means by said display control means, and the opening of said shutter plate partly corresponds to the opening of said dial plate to partly open the opening of said dial plate when the second data is displayed on said electric-optical display means by said display control means.

26. An analog electronic timepiece having an electric-optical display device according to claim 23, wherein the opening of said dial plate has a circular-arc shape, and said shutter plate is rotatable around a pivotal center of said hands and has a first portion, the radius of the outer periphery of which is smaller than the radius of the inner periphery of the opening, and a second portion, the radius of the outer periphery of which is smaller than the radius of the outer periphery of the opening but greater than the radius of the inner periphery of the opening.

27. An analog electronic timepiece having an electric-optical display device according to claim 23, wherein said timepiece further comprises:

lighting means, arranged near to said electric-optical display means, for lighting said electric-optical display means, and lighting drive control means for driving said lighting means when said shutter plate is moved by said shutter plate movement control means to open the opening of said dial plate.

28. An analog electronic timepiece having an electric-optical display device according to claim 23, wherein said shutter plate is formed of a transparent member, and a mask portion is formed in said transparent member to cover the opening of said dial plate.

29. An analog electronic timepiece having an electric-optical display device comprising: a dial plate in which an opening is formed;

time-indicating hand means for pivotally moving hands on said dial plate to indicate the time;

electric-optical display means arranged below the opening of said dial plate and provided with a plurality of display digits for displaying a plurality of character data;

a shutter plate movably mounted between said dial plate and said electric-optical display means;

data generating means for generating a first data consisting of a plurality of character data and a second data consisting of character data, the number of which is smaller than that of the first data;

first display control means for selectively displaying the two types of data generated by said data generating means on said electric-optical display means;

second display control means for terminating the data display on said electric-optical display means; and shutter plate movement control means for moving said shutter plate to a first position, in which all the display digits of the electric-optical display means are exposed, and stopping it at the first position when the first data is displayed on said electric-optical display means by said display control means, for moving said shutter plate to a second position, in which only the display digits of the electric-optical display means showing the second data are exposed, the number of the second-data displaying digits being smaller than the total number of the display digits, and stopping it at the second position when the second data is displayed on said electric-optical display means, and for moving said shutter plate to a third position to completely close the opening of said dial plate when the data display on said electric-optical display means is terminated by said second display control means.

30. An analog electronic timepiece having an electric-optical display device according to claim 29, wherein said shutter plate rotates around a pivotal center of said hands.

31. An analog electronic timepiece having an electric-optical display device according to claim 29, wherein the opening of said dial plate has a circular-arc shape, said shutter plate is rotatable around a pivotal center of said hands and is provided with a circular-arc shaped opening having substantially the same central angle as that of the opening of said dial plate, and the opening of said shutter plate corresponds to the opening of said dial plate to fully open the opening of said dial plate when the first data is displayed on said electric-optical display means by said display control means, and the opening of said shutter plate partly corresponds to the opening of said dial plate to partly open the opening of said dial plate when the second data is displayed on said electric-optical display means by said display control means.

32. An analog electronic timepiece having an electric-optical display device according to claim 29, wherein opening of said dial plate has a circular-arc shape, and said shutter plate is rotatable around a pivotal center of said hands and has a first portion, the radius of the outer periphery of which is smaller than the radius of the inner periphery of the opening, and a second portion, the radius of the outer periphery of which is smaller than the radius of the outer periphery of the opening but greater than the radius of the inner periphery of the opening.

33. An analog electronic timepiece having an electric-optical display device according to claim 29, wherein said timepiece further comprises:

lighting means, arranged near to said electric-optical display means, for lighting said electric-optical display means, and lighting drive control means for driving said lighting means when said shutter plate is moved by said shutter plate movement control means to open the opening of said dial plate.

34. An analog electronic timepiece having an electric-optical display device according to claim 29, wherein said shutter plate is formed of a transparent member, and a mask portion is formed in said transparent member to cover the opening of said dial plate.

* * * * *